US011653424B2

(12) United States Patent
Kimrey, Jr. et al.

(10) Patent No.: US 11,653,424 B2
(45) Date of Patent: May 16, 2023

(54) DATA COLLECTION METHOD AND APPARATUS FOR RADIO FREQUENCY HEATING SYSTEM

(71) Applicants: Harold Dail Kimrey, Jr., Knoxville, TN (US); John Hirschey, Wilmette, IL (US); Tom McCune, Buffalo Grove, IL (US)

(72) Inventors: Harold Dail Kimrey, Jr., Knoxville, TN (US); John Hirschey, Wilmette, IL (US); Tom McCune, Buffalo Grove, IL (US)

( * ) Notice: Subject to any disclaimer, the term of this patent is extended or adjusted under 35 U.S.C. 154(b) by 497 days.

(21) Appl. No.: 16/803,701

(22) Filed: Feb. 27, 2020

(65) Prior Publication Data

US 2020/0281050 A1 Sep. 3, 2020

Related U.S. Application Data

(60) Provisional application No. 62/812,680, filed on Mar. 1, 2019.

(51) Int. Cl.
*H05B 6/68* (2006.01)
*H05B 6/64* (2006.01)

(52) U.S. Cl.
CPC ..... *H05B 6/68* (2013.01); *H05B 6/645* (2013.01); *H05B 6/6467* (2013.01)

(58) Field of Classification Search
CPC ..... H05B 6/60; H05B 6/6411; H05B 6/645; H05B 6/6452; H05B 6/6467; H05B 6/68; H05B 6/701; H05B 6/707; H05B 6/78; H05B 2206/045; G01K 13/00; G01K 13/20; G01K 13/223; G01K 13/25; G01K 1/022; G01K 1/024; G01K 1/026; G01K 1/14; G01K 1/20
See application file for complete search history.

(56) References Cited

U.S. PATENT DOCUMENTS

2006/0016806 A1* 1/2006 Cristiani ..... G01K 13/00 374/E1.004
2008/0043809 A1 2/2008 Herbert
2010/0135357 A1 6/2010 Chancy
2016/0119984 A1 4/2016 Kimrey, Jr.

FOREIGN PATENT DOCUMENTS

KR 10-2008-0087821 A 10/2008
WO 2005/017476 A1 2/2005

OTHER PUBLICATIONS

Search Report and Written Opinion for related PCT Application No. PCT/US2020/020155 dated Jun. 23, 2020, 12 pages.

* cited by examiner

*Primary Examiner* — Hung D Nguyen
(74) *Attorney, Agent, or Firm* — Hovey Williams LLP; Kameron D. Kelly

(57) ABSTRACT

A datalogger with a temperature sensor for measuring the temperature of one or more articles during a radio frequency (RF) heating process. The datalogger may be wireless and may store temperature measurements in an internal memory and/or may wirelessly transmit temperature data in real-time. The datalogger may be specifically designed and oriented to maximize temperature measurement accuracy and minimize interference with the RF heating process.

15 Claims, 7 Drawing Sheets

DATA COLLECTION METHOD AND APPARATUS FOR RADIO FREQUENCY HEATING SYSTEM

CROSS-REFERENCE TO RELATED APPLICATIONS

The present application claims priority from U.S. Provisional Patent Application No. 62/812,680, filed Mar. 1, 2019, and entitled RADIO FREQUENCY HEATING SYSTEM AND METHOD FOR HEATING ARTICLES USING RADIO FREQUENCY ENERGY, the entire disclosure of which is hereby incorporated by reference herein.

FIELD OF THE INVENTION

The present invention relates generally to systems that use radio frequency (300 kHz to 300 MHz) energy to heat articles.

BACKGROUND

Electromagnetic radiation is a known mechanism for delivering energy to an object. The ability of electromagnetic energy to penetrate and heat an object in a rapid and effective manner has proven advantageous for a number of chemical and industrial processes. In the past, radio frequency (RF) energy has been used to heat articles by, for example, induction heating or dielectric heating. However, the use of RF energy to heat articles can have drawbacks. For example, the wavelength of RF energy can make it difficult to transmit and launch RF energy in an efficient manner.

The present invention involves discoveries for minimizing and/or eliminating many of the drawbacks conventionally associated with the use of RF energy to heat articles. For example, in certain circumstances, it can be desirable to measure the internal temperature of an article while it is being heated by RF energy. However, current temperature probes and techniques often provide erroneous readings because the presence of the probes can perturb the local RF energy field and/or the probes themselves can absorb the RF energy, thereby giving temperature readings higher than the actual local temperature of the articles.

SUMMARY

One aspect of the present invention concerns a process for heating a plurality of articles using radio frequency (RF) energy, the process comprising: (a) conveying a plurality of articles through an RF applicator; (b) during at least a portion of the conveying, heating the plurality of articles using RF energy; and (c) during at least a portion of the heating, measuring a temperature of at least one of the articles using a wireless data logger having an elongated probe extending at least partly into the article. The elongated probe is oriented substantially perpendicular to the direction of orientation of the RF energy field used to heat the plurality of articles in the RF applicator.

Another embodiment of the present invention concerns a system for heating a plurality of articles using radio frequency (RF) energy. The system comprises an RF generator for generating RF energy, an RF waveguide for transmitting RF energy produced by the RF generator, an RF applicator for receiving RF energy transmitted by the RF waveguide, a convey system for transporting a plurality of articles through the RF applicator in a convey direction, and at least one wireless datalogger for measuring a temperature in at least one article. The wireless datalogger has an elongated probe extending at least partly into the article and the elongated probe is oriented substantially perpendicular to the convey direction.

Yet another embodiment of the present invention concerns a wireless data logger for sensing and storing temperature data. The data logger comprises a main body, an elongated probe extending from the main body, a temperature sensor coupled to the probe near a distil end of the probe, and an electrically conductive material substantially surrounding the temperature sensor. The electrically conductive material has an electrical conductivity greater than $2\times10^6$ S/m at 20° C.

DETAILED DESCRIPTION

In many commercial processes, it is often desirable to heat large numbers of individually packaged articles in a rapid and uniform manner. The present invention relates to systems and processes for such heating that use radio frequency (RF) energy to heat, or assist in heating, a plurality of articles. Examples of the types of articles that can be processed according to the present invention include, but are not limited to, packaged foodstuffs and beverages, as well as packaged pharmaceuticals, and packaged medical or veterinary fluids. The systems described herein may be configured for pasteurization, for sterilization, or for both pasteurization and sterilization. In general, pasteurization involves the rapid heating of an article or articles to a minimum temperature between about 60° C. and 100° C., about 65° C. to about 100° C., or about 70° C. and 100° C., while sterilization involves heating articles to a minimum temperature between about 100° C. and about 145° C., about 110° C. and about 140° C., or about 120° C. and about 135° C.

Figure 1:
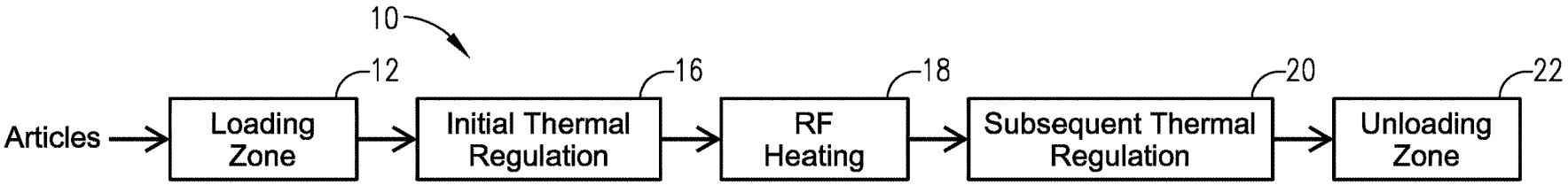
FIG. 1 is a block diagram of the typical zones or steps of an RF heating system or process configured according to various embodiments of the present invention.
Figure 2:
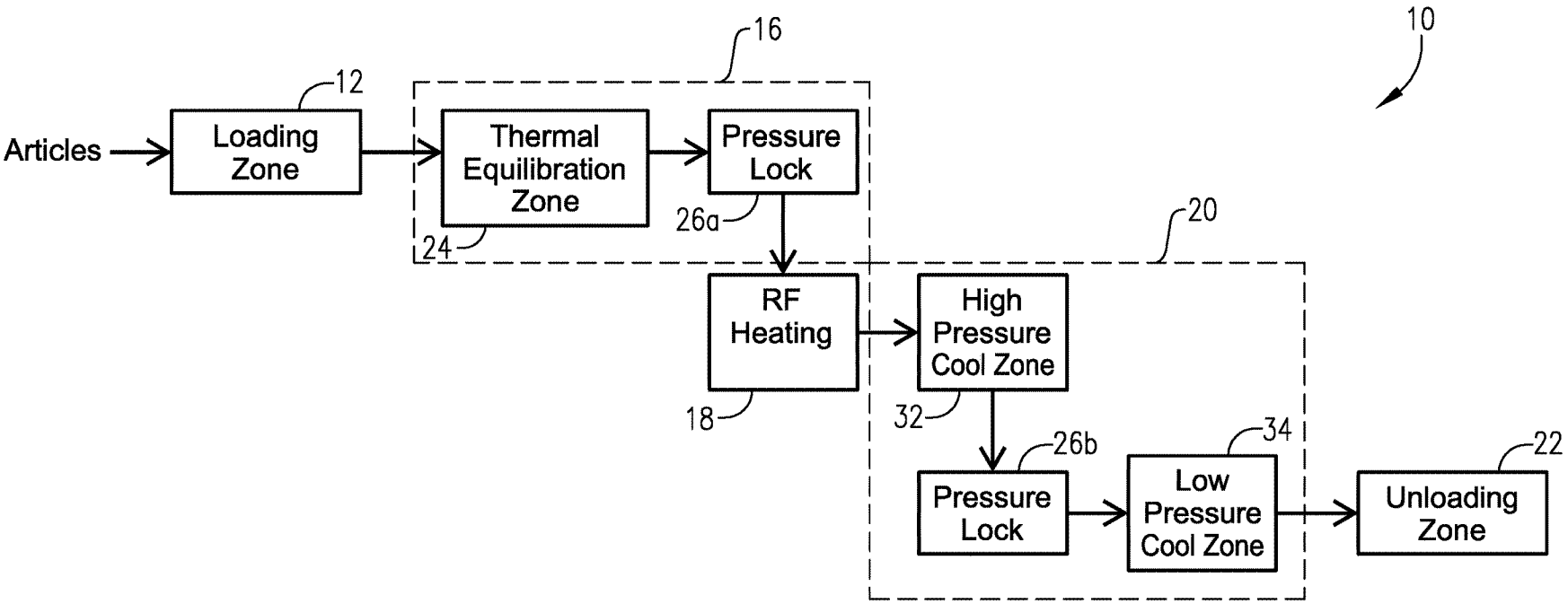
FIG. 2 is a block diagram of the typical zones or steps of an RF heating system according to various embodiments of the present invention, particularly where the system can be used to pasteurize articles.
Figure 3:
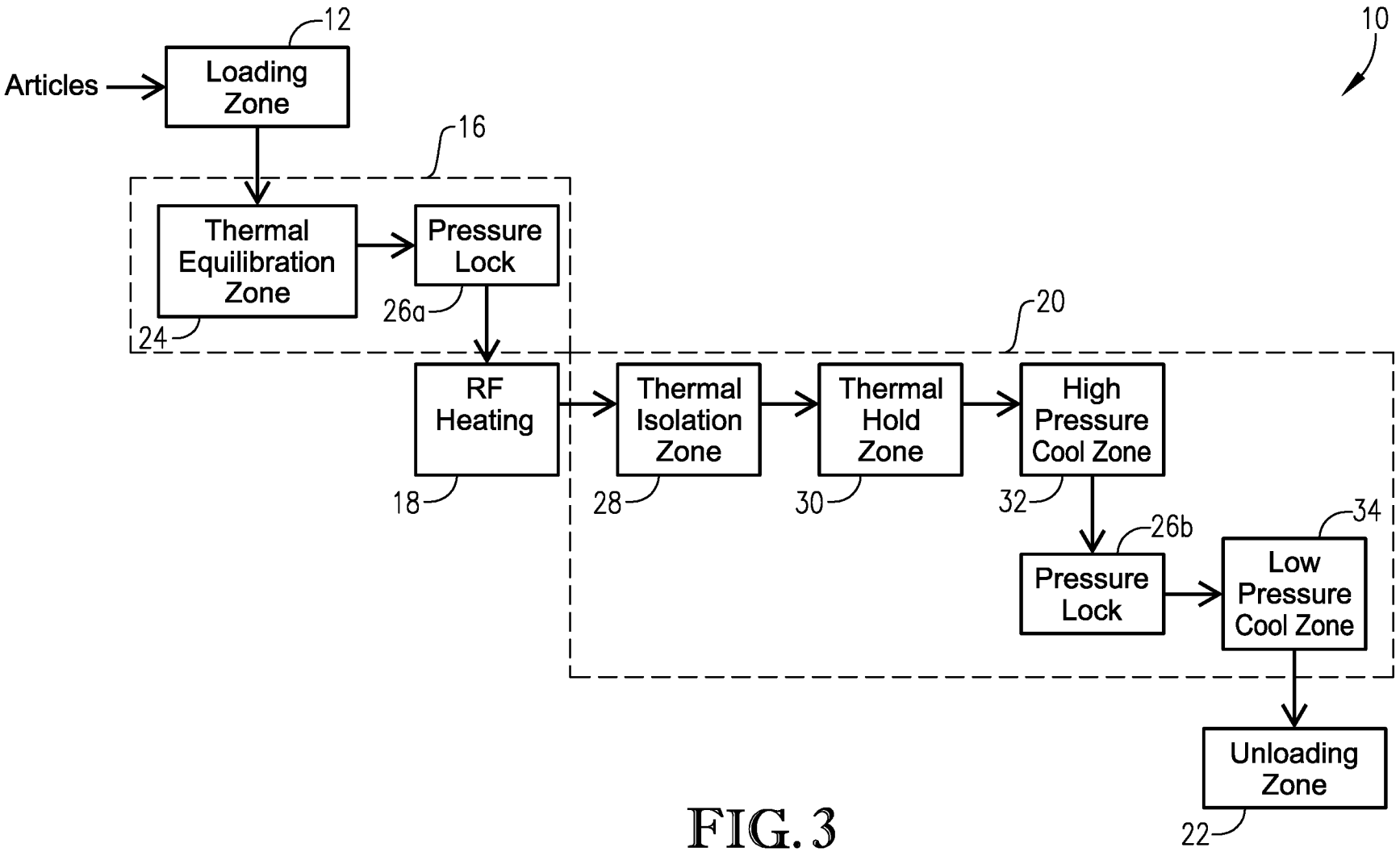
FIG. 3 is a block diagram of typical zones or steps of an RF heating system according to various embodiments of the present invention, particularly where the system can be used to sterilize articles.

FIGS. 1-3 are overall diagrams of various embodiments of an RF heating system 10. As shown in FIGS. 1-3, articles introduced into the RF heating system 10 can pass from a loading zone 12 into an optional initial thermal regulation section 16, wherein the articles can be thermally treated to achieve a substantially uniform temperature. Next, the articles can be introduced into an RF heating section 18, wherein the articles can be rapidly heated using RF energy, as described in further detail below. The heated articles are then passed through a subsequent thermal regulation section 20, wherein the temperature of the articles can again be regulated. In some embodiments, as shown in FIG. 3, the subsequent thermal regulation section 20 may also include a thermal hold zone 30 in which the articles can be maintained at a constant temperature for a specified amount of time. Additionally, as shown in FIGS. 2 and 3, the subsequent thermal regulation section 20 may also include a high-pressure cooling zone 32 and a low-pressure cooling zone 34 for reducing the maximum surface temperature of the articles to a suitable handling temperature (e.g., 20° C. to 80° C.). Additional details regarding RF heating systems and sections thereof suitable for use in embodiments of the present invention are provided in co-pending U.S. patent application Ser. No. 16/163,481, the entire disclosure of which is incorporated herein by reference to the extent not inconsistent with the present disclosure.

In some embodiments, each of the initial thermal regulation section 16, RF heating section 18, and subsequent thermal regulation section 20 may be defined in a single vessel, while in other embodiments, at least one of these stages may be defined within two or more separate vessels. Additionally, one or more transition zones between individual processing stages or steps may also be defined in one or more separate vessels, or one or more of those transition zones may be defined within the same vessel as at least one preceding (e.g., upline) or subsequent (e.g., downline) stage or zone.

One or more of the vessels defining the initial thermal regulation section 16, the RF heating section 18 and/or the subsequent thermal regulation section 20 may be configured to be at least partially liquid-filled. As used herein, the terms "liquid-filled," or "filled with liquid," denote a configuration in which at least 50 percent of the total internal volume of a vessel is filled with liquid. In certain embodiments, at least about 60, at least about 70, at least about 80, at least about 90, at least about 95, or at least about 99 percent of the total internal volume of one or more vessels may be filled with liquid. While being passed through a liquid-filled vessel, the articles may be at least partially, or completely, submerged in liquid during the processing step performed in that vessel. When two or more vessels are at least partially liquid-filled, the liquid in one vessel may be the same as, or different than, the liquid in another adjacent vessel. Thus, articles that are at least partially submerged in one type of liquid during the processing step performed in one vessel may be at least partially submerged in the same or in a different type of liquid during the processing step performed in a previous or subsequent vessel.

The liquid used in the vessel or vessels of RF heating system can be any suitable non-compressible fluid that exists in a liquid state at the operating conditions within the vessel. The liquid may have a dielectric constant greater than the dielectric constant of air. In some cases, the liquid may have a dielectric constant similar to the dielectric constant of the packaged substance being processed. For example, the dielectric constant of the liquid may be at least about 20, at least about 25, at least about 30, at least about 35, or at least about 40 and/or not more than about 120, not more than about 110, not more than about 100, not more than about 80, or not more than about 70, measured at a temperature of 80° C. and a frequency of 100 MHz. Water (or a liquid comprising water) may be particularly suitable for systems used to heat ingestible substances such as foodstuffs and medical or pharmaceutical fluids. Additives such as, for example, oils, alcohols, glycols, or salts, may be optionally be added to the liquid medium to alter or enhance its physical properties (e.g., boiling point) during processing, if needed.

The articles passing through the RF heating system may be contacted with liquid during at least a portion, or substantially all, of the travel path through the initial thermal regulation section 16, the RF heating section 18, and/or the subsequent thermal regulation section 20. For example, in some embodiments, the initial thermal regulation section 16, the RF heating section 18, and the subsequent thermal regulation section 20 can be configured to maintain the articles in substantially continuous contact with liquid, thereby defining a liquid contact zone between the point at which the articles are initially contacted with liquid, such as, for example by spraying or submersion, and the point at which the articles are removed from contact with the liquid. In some embodiments, the liquid contact zone may include all or a portion of initial thermal regulation section 16, RF heating section 18, and/or subsequent thermal regulation section 20. In other embodiments, the articles may not be submerged in, or even in contact with, liquid in all or a portion of initial thermal regulation section 16, RF heating section 18, and/or subsequent thermal regulation section 20.

The RF heating system described herein may be configured to heat many different types of articles. Each article may include, for example, a sealed package surrounding at least one ingestible substance. Examples of ingestible substances can include, but are not limited to, food, beverages, medical, or pharmaceutical items suitable for human and/or animal consumption or use. A packaged article may include a single type of foodstuff (or other ingestible substance), or it may include two or more different ingestible substances, which may be in contact with each other or separated from one another within the package. The total volume of foodstuff (or other ingestible substance) within each sealed package can be at least about 4, at least about 6, at least about 8, at least about 10, at least about 20, at least about 25, or at least about 50 cubic inches and/or not more than about 500, not more than about 400, not more than about 300, not more than about 200, or not more than about 100 cubic inches.

In certain embodiments, the foodstuff or other ingestible substance being heated may have a dielectric constant of at least about 20 and not more than about 150. Additionally, or in the alternative, the foodstuff or other ingestible substance may have a dielectric loss factor of at least about 10 and not more than about 1500. Unless otherwise noted, the dielectric constant and dielectric loss factors provided herein are measured at a frequency of 100 MHz and a temperature of 80° C. In other embodiments, the foodstuff or other ingestible substance can have a dielectric constant of at least about 25, at least about 30, at least about 35, or at least about 40 and/or not more than about 140, not more than about 130, not more than about 120, not more than about 110, not more than about 100, not more than about 90, not more than about 80, not more than about 70, or not more than about 60, or it can be in the range of from about 20 to about 150, about 30 to about 100, or about 40 to about 60. Additionally, the foodstuff or other ingestible substance can have a dielectric loss factor of at least about 10, at least about 25, at least about 50, at least about 100, at least about 150, or at least about 200 and/or not more than about 1500, not more than about 1250, not more than about 1000, or not more than about 800, or it can be in the range of from about 10 to about 1500, about 100 to about 1250, or about 200 to about 800.

Examples of suitable ingestible substances can include solid foodstuffs such as, for example, fruits, vegetables, meats, soups, pastas, and pre-made meals. In other embodiments, the articles heated in the RF heating system can comprise packaged medical or pharmaceutical fluids or medical or dental instruments. In still other embodiments, the ingestible substance within the package can comprise a liquid or semi-liquid. As used herein, the term "semi-liquid" refers to a liquid that also includes a gas, another liquid, or a solid, such as, for example, an emulsion, a suspension, a gel, or a solution. Semi-liquids can also include larger pieces of solid material, such as chunks of meat and vegetables in a soup or stew or pieces of fruit in a jam. Examples of suitable semi-liquids can include, but are not limited to, soups, stews, jams, sauces, gravy, or beverages.

The articles processed within the RF heating system can include packages of any suitable size and shape. In one embodiment, each package can have a length (longest dimension) of at least about 2 inches, at least about 4 inches, at least about 6 inches, or at least about 8 inches and/or not more than about 30, not more than about 20, not more than about 18, not more than about 15, not more than about 12, or not more than about 10 inches and a width (second longest dimension) of at least about 1 inch, at least about 2 inches, at least about 4 inches and/or not more than about 12 inches, not more than about 10 inches, or not more than about 8 inches.

In some embodiments, the packages can have a generally cylindrical shape and may include, for example, cans, jars, bottles, and/or other containers. When the packages have a cylindrical shape, the width of the package may be its diameter. In other embodiments, the package can have a generally rectangular or prism-like shape or may be a pouch. Such packages may also have a depth (shortest dimension) of at least about 0.10, at least about 0.25, at least about 0.5 inches, at least about 1 inch, at least about 2 inches and/or not more than about 8 inches, not more than about 6 inches, not more than about 4 inches, not more than about 2 inches, or not more than about 1 inch.

The articles can be in the form of separated individual items or packages or can be in the form of a continuous web of connected items or packages passed through the RF heating system. The items or packages may be constructed of any material, including plastics, cellulosics, and other substantially RF-transparent materials. The articles can be flexible, rigid, or semi-rigid.

The RF heating system can also include at least one conveyance system for transporting the articles through one or more of the processing zones described above. Examples of suitable conveyance systems can include, but are not limited to, plastic or rubber belt conveyors, chain conveyors, roller conveyors, flexible or multi-flexing conveyors, wire mesh conveyors, bucket conveyors, pneumatic conveyors, screw conveyors, trough or vibrating conveyors, helical conveyors, and combinations thereof. The conveyance system can include any number of individual convey lines and can be arranged in any suitable manner within the process vessels. The conveyance system utilized by the RF heating system can be configured in a generally fixed position within the vessel or at least a portion of the system can be adjustable in a lateral or vertical direction.

When the articles comprise individual packages, the articles may be transported through all or a portion of the RF heating system in a carrier. When used, the carrier can include an outer frame, upper and lower retention grids, and optionally a dielectric nest. The dielectric nest can include a plurality of openings for receiving the individual articles being heated. In some embodiments, the carrier may not include a dielectric nest, so that the individual articles are placed between and in contact with the upper and lower retention grids. Additional details of suitable carriers and other details about an RF heating system are described in U.S. Patent Application Publication No. 2016/0119984, which is incorporated herein by reference to the extent not inconsistent with the present disclosure.

Figure 4A:
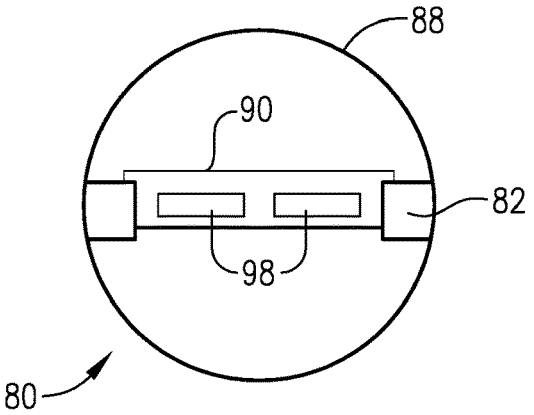
FIG. 4*a* is a schematic cross-sectional view of a vessel configured according to embodiments of the present invention, particularly illustrating use of a carrier to transport articles through the vessel.
Figure 4B:
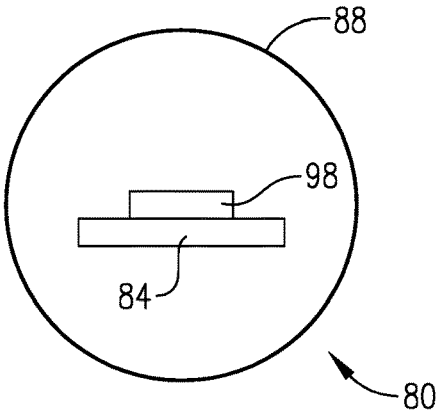
FIG. 4*b* is a schematic cross-sectional view of a vessel configured according to embodiments of the present invention, particularly illustrating transport of articles through the vessel without a carrier.

In some embodiments, as shown in FIG. 4*a*, the articles 98 loaded in a carrier 90 can be moved through one or more vessels 88 using a convey system 80, that can include, for example, a chain drive 82. Alternatively, no carrier is used to transport the articles through all or a portion of the RF heating system, so that the individual articles 98 are in contact with a portion of the convey line 84 as they are transported through the vessel 88, as generally illustrated in FIG. 4*b*.

Turning back to FIGS. 1-3, the articles may be initially introduced into a loading zone 12. In some embodiments, the loading zone 12 may be configured to initially contact the articles with liquid. This contacting may include, for example, spraying the articles with and/or at least partially submerging the articles in liquid. The articles introduced into the loading zone 12 may have an average temperature, measured at the geometric center of each article, of at least about 5, at least about 10, at least about 15, at least about 20, at least about 25, or at least about 30° C. and/or not more than about 70, not more than about 60, not more than about 50, not more than about 40, or not more than about 30° C. As used herein, the "geometric center" of an article is the common point of intersection of planes passing through the midpoints of the article's length, width, and height. The loading zone may be operated at approximately ambient temperature and/or pressure.

As shown in FIGS. 1-3, the articles may be passed from a loading zone 12 into the initial thermal regulation zone 16, when present. When introduced into the initial thermal regulation section 16, the average temperature at the geometric center of the articles can be at least about 5, at least about 10, at least about 15, at least about 20, at least about 25, or at least about 30° C. and/or not more than about 90, not more than about 80, not more than about 70, not more than about 60, not more than about 50, or not more than about 40° C. For pasteurization systems, the temperature at the geometric center of the articles introduced into initial thermal regulation section 16 may be in the range of from about 5° C. to about 70° C. or about 25° C. to about 40° C., while it may be in the range of from about 15° C. to about 90° C. or about 30° C. to about 60° C. for sterilization systems.

In certain embodiments, the initial thermal regulation section 16 may be configured to change the temperature of each article, measured at its geometric center, by at least about 1, at least about 5, at least about 10, at least about 15, or at least about 20° C. and/or not more than about 60, not more than about 55, not more than about 50, not more than about 45, not more than about 40, not more than about 35, or not more than about 30° C., or it can be changed by an amount in the range of from about 1° C. to about 60° C. or about 10° C. to about 30° C. Depending on the temperature of the articles introduced into the initial thermal regulation section 16, the temperature change may be an increase or decrease in an amount within the above ranges.

In certain embodiments, the average temperature at the geometric center of the articles exiting the initial thermal regulation section 16 may be at least about 25, at least about 30, at least about 35, at least about 40, at least about 45, at least about 50, at least about 55, or at least about 60° C. and/or not more than about 90, not more than about 85, not more than about 80, not more than about 75, not more than about 70, or not more than about 65° C. During pasteurization, the average temperature at the geometric center of the articles exiting the initial thermal regulation section 16 can be in the range of from about 25° C. to about 90° C. or about 40° C. to about 70° C., while it may be in the range of from about 40° C. to about 90° C., or about 60° C. to about 80° C. during sterilization. When no initial thermal regulation section 16 is present, the articles introduced into the RF heating section 18 from the loading zone 12 can have temperatures within the above ranges.

Additionally, when present, the initial thermal regulation section 16 may be configured to regulate the temperature of the articles passing therethrough to promote temperature uniformity amongst the articles. For example, in certain embodiments, the temperature of the articles may be regulated within the initial thermal regulation section 16 so that the average difference between the maximum temperature (i.e., hottest portion) and the minimum temperature (i.e., coldest portion) of each article exiting the initial thermal regulation section 16 can be not more than about 5, not more than about 2.5, not more than about 2, not more than about 1.5, not more than about 1, or not more than about 0.5° C. Similar differences can be achieved between the temperatures of adjacent articles removed from the initial temperature regulation section 16, measured at the geometric center of each article.

In certain embodiments, the articles can have an average residence time in the initial thermal regulation section 16 of at least about 10, at least about 15, at least about 20, or at least about 25 minutes and/or not more than about 70, not more than about 65, not more than about 60, not more than about 55, not more than about 50, not more than about 45, or not more than about 40 minutes, or it can be in the range of from about 10 to about 70 minutes, or about 25 to about 40 minutes.

As shown in FIGS. 2 and 3, whether the RF heating system is configured for pasteurization or sterilization, the initial thermal regulation section 16 may include a thermal equilibration zone 24 followed by an optional pressure lock 26. The thermal equilibration zone 24 may be configured to change the temperature of the articles passing therethrough in order to promote temperature uniformity within each article and amongst the articles passing therethrough, as described previously. In certain embodiments, articles passing through the thermal equilibration zone 24 may be contacted with liquid during at least a portion of the thermal equilibration step. The liquid may comprise or be water and can have a temperature within about 25, within about 20, within about 15, or within about 10° C. of the average temperature at the geometric center of the articles introduced into the thermal equilibration zone 24.

The contacting may be performed by any suitable method including, but not limited to, by spraying the articles with and/or by submerging, or partially submerging, the articles in liquid. In some embodiments, the thermal equilibration zone 24 may further include one or more liquid jets for discharging streams of pressurized liquid toward the articles. Such pressurization may increase the Reynolds number of the liquid surrounding the article to values above, for example, 4500, thereby enhancing heat transfer. When present, the liquid jets may be positioned along or more walls of the vessel in which the thermal equilibration step is performed and may be used whether or not the articles are additionally submerged in liquid.

The articles exiting the thermal equilibration zone 24 shown in FIGS. 2 and 3 can have an average temperature, measured at the geometric center of the articles, of at least about 25, at least about 30, at least about 35, at least about 40, at least about 45, at least about 50, at least about 55, or at least about 60° C. and/or not more than about 90, not more than about 85, not more than about 80, not more than about 75, not more than about 70, or not more than about 65° C. When the articles are being pasteurized, the average temperature at the geometric center of the articles exiting the thermal equilibration zone 24 can be in the range of from about 25° C. to about 90° C. or about 40° C. to about 70° C., while it may be in the range of from about 40° C. to about 90° C., or about 60° C. to about 80° C. when the articles are being sterilized. The heated articles may also have a substantially uniform temperature such that, for example, the temperature at the geometric center of adjacent articles exiting the thermal equilibration zone 24 can be within about 2, within about 1.5, within about 1, or within about 0.5° C. of one another.

As shown in FIGS. 2 and 3, after exiting the thermal equilibration zone 24 of the initial thermal regulation section 16, the articles may then be passed through a pressure lock **26*a* before entering the RF heating section 18. In general, a pressure lock can be any device suitable for transitioning the articles between two environments having different pressures. Pressure locks may transition the articles from a higher-pressure environment to a lower-pressure environment or from a lower-pressure environment to a higher-pressure environment. In certain embodiments, pressure lock 26*a* may be configured to transition the articles from the lower-pressure thermal equilibration zone 24 when present or from the ambient-pressure loading zone 12 to the higher-pressure RF heating section 18. In certain embodiments, the RF heating section 18 can have a pressure that is at least about 2, at least about 5, at least about 10, or at least about 15 psig and/or not more than about 50, not more than about 40, not more than about 30, not more than about 20, or not more than about 10 psig higher than the pressure in the thermal equilibration zone 24, when present, or in loading zone 12**.

Referring again to FIGS. 2 and 3, articles exiting the pressure lock 26*a* may be introduced into the RF heating section 18. In RF heating section 18, the articles may be rapidly heated via exposure to RF energy. As used herein, the term "RE energy" or "radio frequency energy" refers to electromagnetic energy having a frequency of greater than 300 kHz and less than 300 MHz. In certain embodiments, the RF heating section 18 can utilize RF energy having a frequency of at least about 500 kHz, at least about 1 MHz, at least about 5 MHz, at least about 10 MHz, at least about 20 MHz, at least about 30 MHz, at least about 40 MHz, or at least about 50 MHz. Additionally, or in the alternative, the RF heating section 18 may utilize RF energy having a frequency of not more than about 250 MHz, not more than about 200 MHz, or not more than about 150 MHz. The frequency of the RF energy utilized in the RF heating section 18 can be in the range of from 50 to 150 MHz.

In addition to RF energy, the RF heating section 18 may optionally utilize one or more other types of heat sources such as, for example, conductive or convective heat sources, or other conventional heating methods or devices. However, at least about 35, at least about 45, at least about 55, at least about 65, at least about 75, at least about 85, at least about 95 percent, or substantially all, of the energy used to heat the articles within the RF heating section 18 can be derived from an RF energy source. In some embodiments, not more than about 50, not more than about 40, not more than about 30, not more than about 20, not more than about 10, or not more than about 5 percent or substantially none of the energy used to heat the articles in the RF heating section 18 may be provided by other heat sources, including non-RF electromagnetic radiation having a frequency greater than 300 MHz. The RF energy is not microwave energy and does not have a frequency in the microwave energy band.

According to one embodiment, the RF heating section 18 can be configured to increase the temperature of the articles above a minimum threshold temperature. In embodiments where the RF heating system is configured to sterilize a plurality of articles, the minimum threshold temperature can be at least about 120° C., at least about 121° C., at least about 122° C. and/or not more than about 130° C., not more than about 128° C., or not more than about 126° C. The RF heating section 18 can be operated at approximately ambient pressure, or it can include one or more pressurized RF chambers operated at a pressure of at least about 5 psig, at least about 10 psig, at least about 15 psig and/or not more than about 80 psig, not more than about 60 psig, or not more than about 40 psig. In one embodiment, the pressurized RF chamber can have an operating pressure such that the articles being heated can reach a temperature above the normal boiling point of the liquid medium employed therein.

In some embodiments, the articles passing through the RF heating section 18 may be at least partially submerged in liquid while being heated with RF energy. In some embodiments, the liquid may be the same liquid in which the articles were submerged while passing through the initial thermal regulation section 16. The RF heating section 18 may be at least partially defined within a pressurized vessel so that the pressure in the RF heating zone or within the RF applicator is maintained at a pressure of at least about 2, at least about 5, at least about 10, or at least about 15 psig and/or not more than about 80, not more than about 75, not more than about 70, not more than about 65, not more than about 60, not more than about 55, not more than about 50, not more than about 45, not more than about 40, not more than about 35, not more than about 30, not more than about 25, not more than about 20 psig during the heating step. When the articles passing through the RF heating section 18 are being pasteurized, the pressure in the RF heating section 18 may be in the range of from about 1 psig to about 40 psig or about 2 psig to about 20 psig. When the articles passing through the RF heating section 18 are being sterilized, the pressure in the RF heating section 18 may be in the range of from about 5 psig to about 80 psig, or about 15 psig to about 40 psig. When pressurized, the RF heating section 18 may or may not be at least partially filled with liquid and the articles may or may not be least partially submerged in liquid during the heating.

The temperature at the geometric center of the articles introduced into the RF heating section 18 can be at least about 25, at least about 30, at least about 35, at least about 40, at least about 45, at least about 50, at least about 55, or at least about 60° C. and/or not more than about 110, not more than about 105, not more than about 100, not more than about 95, not more than about 90, not more than about 85, not more than about 80, not more than about 75, not more than about 70° C. When the articles are being pasteurized, the temperature at the geometric center of the articles introduced into the RF heating section 18 can be in the range of from about 25° C. to about 90° C. or about 40° C. to about 70° C., while articles being sterilized may have a temperature at the geometric center of the articles in the range of from about 40° C. to about 110° C. or about 60° C. to about 90° C. when entering the RF heating section 18.

In certain embodiments, the RF heating section 18 may be configured to heat the articles passing therethrough so that the temperature of the geometric center of the articles increases by at least about 10, at least about 15, at least about 20, at least about 25, at least about 30, at least about 35, at least about 40, at least about 45, or at least about 50° C. and/or not more than about 120, not more than about 110, not more than about 100, not more than about 90, not more than about 85, not more than about 80, not more than about 75, not more than about 70, not more than about 65, not more than about 60, not more than about 55, not more than about 50, not more than about 45, or not more than about 40° C.

When the articles are being pasteurized, the RF heating section 18 may be configured to increase the temperature of the geometric center of the articles by an amount in the range of from about 10° C. to about 60° C. or about 20° C. to about 40° C. When the articles are being sterilized, the RF heating zone may be configured to increase the temperature of the geometric center of the articles by an amount in the range of from about 20° C. to about 120° C. or about 35° C. to about 65° C. The RF heating section 18 can be configured to heat the articles at a heating rate of at least about 5° C. per minute (° C./min), at least about 10° C./min, at least about 15° C./min, at least about 20° C./min, at least about 25° C./min, at least about 35° C./min and/or not more than about 75° C./min, not more than about 50° C./min, not more than about 40° C./min, not more than about 35° C./min, not more than about 30° C./min, not more than about 25° C./min, not more than about 20° C./min, or not more than about 15° C./min.

The articles introduced into the RF heating section 18 may be heated to the desired temperature in a relatively short period of time. In some cases, this may help minimize damage or degradation of the foodstuff or other ingestible substance being heated. In certain embodiments, the articles passed through RF heating section 18 may have an average residence time in the RF heating section 18 (also called an RF heating period) of at least about 0.1, at least about 0.25, at least about 0.5, at least about 0.75, at least about 1, at least about 1.25, or at least about 1.5 minutes and/or not more than about 10, not more than about 8, not more than about 6, not more than about 5.5, not more than about 5, not more than about 4.5, not more than about 4, not more than about 3.5, not more than about 3, not more than about 2.5, not more than about 2, not more than about 1.5, or not more than about 1 minute. When the articles are being pasteurized, the average residence time of each article in the RF heating section 18 may be in the range of from about 0.1 minutes to 3 minutes, or 0.5 minutes to 1.5 minutes. When the articles are being sterilized, each article may have an average residence time in the range of from about 0.5 minutes to about 6 minutes, or about 1.5 minutes to about 3 minutes.

In some embodiments, the temperature at the geometric center of the articles exiting the RF heating section 18 can be at least about 60, at least about 65, at least about 70, at least about 75, at least about 80, at least about 85, at least about 90, at least about 95, at least about 100, at least about 105, or at least about 110° C. and/or not more than about 135, not more than about 130, not more than about 125, not more than about 120, not more than about 115, not more than about 110, or not more than about 105° C. When being pasteurized, the temperature at the geometric center of the articles exiting the RF heating section 18 can be in the range of from about 65° C. to about 115° C. or about 80° C. to about 105° C. When being sterilized, the temperature at the geometric center of articles exiting the RF heating section 18 can be in the range of from about 95° C. to about 135° C., or about 110° C. to about 125° C.

Figure 5:
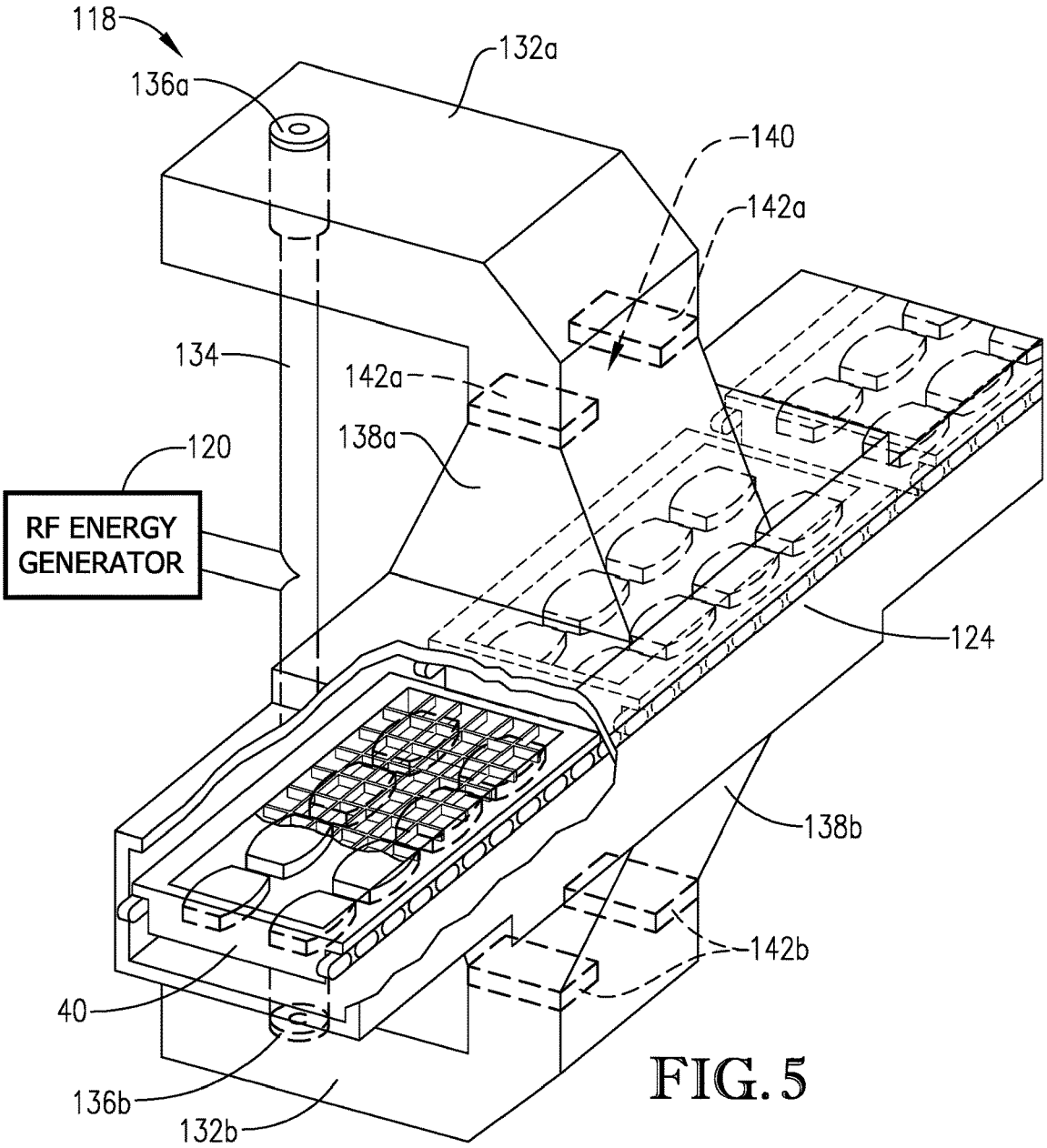
FIG. 5 is a cutaway isometric view of a portion of an RF heating section configured according to embodiments of the present invention.
Figure 6:
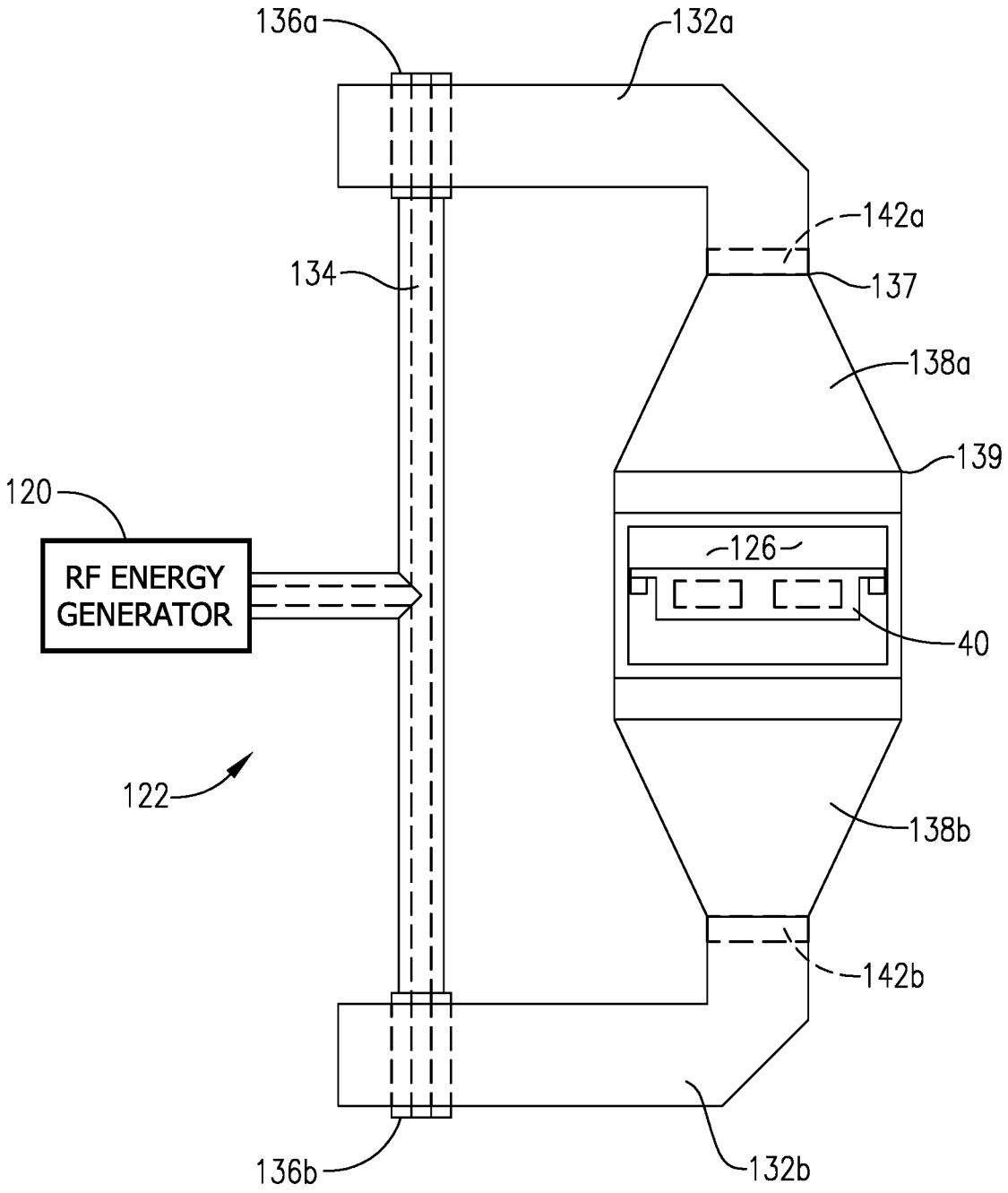
FIG. 6 is an end view of the RF heating section shown in FIG. 5.

Turning now to FIGS. 5 and 6, various views of an RF heating section 118 configured according to embodiments of the present invention are shown. The RF heating section 118 may include an RF generator 120, an RF energy transmission system 122, and an RF applicator 124, which can define an RF heating zone therein. RF energy from the RF generator 120 may be passed by the RF energy transmission system 122 and discharged into the RF applicator 124. Once in the RF applicator 124, the RF energy may be used to heat articles passing therethrough via at least one convey system 130.

The RF generator 120 may be any device suitable for producing RF energy. In certain embodiments, the RF generator 120 can generate power in an amount of at least about 10, at least about 20, at least about 25, at least about 30, at least about 35 kW and/or not more than about 500, not more than about 250, not more than about 200, not more than about 150, not more than about 100, or not more than about 50 kW. RF heating systems of the present invention may use a single RF generator, or two or more RF generators to provide sufficient energy to the RF heating zone 126.

The RF applicator 124 can be configured to act as a resonant cavity for the RF energy. In some embodiments, the RF applicator 124 can be pressurized so that the pressure within the interior of applicator 124 during operation is at least about 5, at least about 10, at least about 15, at least about 20, at least about 25, at least about 30, or at least about 35 psig. As used herein, the unit of "psig" in reference to the pressure within the RF applicator 124 (or any other process vessel) is measured as the pressure above ambient fluid pressure within the vessel. Alternatively, or in addition, the RF applicator 124 can be at least partially filled with liquid. Any suitable liquid may be used, including, for example, liquid that comprises or is water. The liquid may have a conductivity within one or more of the ranges provided herein. In some embodiments, the RF applicator can be both pressurized and at least partially liquid-filled.

The RF energy transmission system 122 is configured to transport RF energy from the RF generator 120 toward the RF applicator 124. Several components of an RF energy transmission system 122 configured according to various embodiments of the present invention are shown in FIGS. 5 and 6. For example, the RF energy transmission system 122 can include at least one RF waveguide 132 for transporting RF energy from the RF generator 120 toward the RF applicator 124. Additionally, in some embodiments, the RF energy transmission system 122 can include at least two waveguides 132*a,b* configured to pass RF energy into opposite sides of the RF applicator 124. In some embodiments, the waveguides 132*a,b* may be oppositely facing, or may be staggered from one another in a direction parallel to the central axis of elongation of the RF applicator 124. At least one of the RF waveguide 132 and the RF applicator 124 can be filled with liquid. In some embodiments, In some embodiments, shown for example in FIG. 5, the RF energy transmission system 122 can include at least one coaxial conductor 134, at least one waveguide 132*a,b*, and at least one coax-to-waveguide transition 136*a,b*. In these embodiments, RF energy produced by the RF generator 120 may be transferred by the coaxial conductor 134 and into the waveguide 132*a,b*. The coax-to-waveguide transition 136*a,b* may be configured to transition the RF energy from the coaxial conductor 134 into the waveguide 132*a,b*, which guides the RF energy into the RF applicator 124. The coaxial conductor 134 may include an inner conductor and an outer conductor that extend coaxially from the RF energy generator 120 to the inlet of the waveguide 132*a,b*. As shown in FIG. 6, the outer conductor may terminate at the wall of the waveguide 132, while the inner conductor may extend through one wall of the waveguide 132 and into its interior to form the coax-to-waveguide transition 136. Optionally, the inner conductor may extend through the opposite wall of the waveguide. A dielectric sleeve may surround the inner conductor where the inner conductor penetrates the wall or walls of the waveguide 132 in order to prevent fluid from flowing into the coaxial conductor 134. The dielectric sleeve may be formed from any material capable of being sealed with the waveguide and that is substantially transparent to RF energy. One example of a suitable material includes, but is not limited to, glass fiber filled polytetrafluoroethylene (PTFE).

In addition, as shown in FIGS. 5 and 6, the RF energy transmission system 122 may also include at least one RF launcher 138 located between the waveguide 132 and the RF applicator 124 for emitting RF energy into the RF applicator 124. In some embodiments, no launcher is present such that the waveguides 132*a,b* are configured to emit RF energy directly into the RF applicator 124. When present, each RF launcher 138 is configured to discharge energy from the waveguide 132 into the RF applicator 124 and may include, for example, a narrow end 137 and a broad end 139. As shown in FIG. 6, the narrow end 137 can be coupled to the waveguide 132, while the broad end 139 can be coupled to the RF applicator 124. In some embodiments, the RF energy transmission system 122 can include two or more RF launchers positioned on generally opposite sides of the RF applicator, as shown in FIGS. 5 and 6, while, in some embodiments, the RF energy transmission system 122 may include two or more same-side RF launchers positioned on generally the same side of the RF applicator.

In certain embodiments, at least one of the RF applicator 124 and the RF waveguide 132 may be configured to be or be filled with liquid, such as, for example, water. When the waveguide 132 is at least partially filled with liquid, it may be capable of transmitting RF energy produced by said RF generator 120 towards the RF applicator 124. The dimensions of the waveguide may be much smaller than if the waveguide were filled with air. For example, in certain embodiments, the waveguide 132 can have a generally rectangular cross-section with the dimension of the widest waveguide wall being in the range of from about 5 inches to about 40 inches or about 12 inches to about 20 inches, and the dimension of the narrowest waveguide wall being in the range of from about 2 inches to about 20 inches, about 4 inches to about 12 inches, or about 6 inches to about 10 inches. In some embodiments, as shown in FIG. 5, the waveguide 132 can optionally include a pair of inductive iris panels 142*a,b* disposed within the interior of the waveguide 132 through which the RF energy may pass.

In certain embodiments, the RF applicator 124 can be in open communication with the interior of at least one RF waveguide 132. As used herein, the terms "open communication" or "open to" mean that a fluid present in the RF applicator 124 and a fluid within the waveguide 132 may be permitted to flow therebetween with little or no restriction. When the interior of the RF applicator 124 is in open communication with the interior of the waveguide 132, each can have a similar pressure. In some embodiments, the pressure within the RF applicator 124 and the interior of the waveguide 132 can be at least about 5, at least about 10, at least about 15, at least about 20, or at least about 25 psig and/or not more than about 80, not more than about 70, not more than about 60, not more than about 50, not more than about 40, or not more than about 35 psig. When the articles passing through the RF applicator 124 are being pasteurized, the pressure in the RF applicator and/or RF waveguide 132 can be in the range of from about 1 psig to about 40 psig or about 2 psig to about 20 psig. When the articles passing through the RF applicator 124 are being sterilized, the pressure can be in the range of from about 5 psig to about 80 psig, or about 15 psig to about 40 psig.

In certain embodiments, the interior of the RF applicator 124 and the interior of the waveguide 132 may be filled with a common liquid. The liquid can act as a transfer medium through which RF energy is passed as it is directed toward to the articles in the RF applicator 124. The liquid can comprise, or be, any of the aforementioned types of liquid and, in some embodiments, may be pretreated in order to minimize its conductivity. For example, in some embodiments, the liquid may be treated so that it has a conductivity of not more than about 100, not more than about 90, not more than about 80, not more than about 70, not more than about 60, not more than about 50, not more than about 40, not more than about 30, not more than about 20, not more than about 10, not more than about 5, not more than about 1, not more than about 0.5, not more than about 0.1, or not more than about 0.05, or not more than about 0.01 mS/m. In some embodiments, the liquid can comprise or be deionized or distilled water.

Alternatively, the interior of the RF applicator 124 and the RF waveguide 132 can be filled with different fluids. For example, the RF applicator 124 may be filled with one liquid, and the waveguide 132 may be filled with another, different liquid. In some embodiments, the RF heating section 118 may further include at least one window positioned in each of the RF waveguides 132*a,b* between the RF generator 120 and the interior of the RF applicator 124. The window, when present, may be substantially transparent to RF energy, while still being capable of fluidly sealing the waveguide 132 from the interior of the RF applicator 124. In some embodiments, when present, the window 148 may form at least a portion of the sidewall of the RF applicator 124. When the RF energy transmission system 122 includes an RF launcher 138*a,b* and one or more windows, the windows may be positioned near the broad end 139 of the RF launcher 138*a,b* near the RF applicator 124.

The RF heating section may include at least one convey system 130 for transporting the articles in a convey direction through the RF heating zone 126 and into and out of the RF applicator 124. The convey system 130 may include at least one conveyor and at least one driver for moving the conveyor in the convey direction. In some cases, the convey direction can be substantially horizontal, while in other cases, it can be substantially vertical. Any suitable type of conveyor can be used, including, for example, plastic or rubber belt conveyors, chain conveyors, roller conveyors, flexible or multi-flexing conveyors, wire mesh conveyors, bucket conveyors, pneumatic conveyors, trough conveyors, vibrating conveyors, helical conveyors, and combinations thereof. The conveyor may comprise a single convey segment, or it may include two or more convey segments arranged in parallel or in series. In some embodiments, the convey system is oriented within the RF applicator 124 so that the convey direction is substantially parallel to the central axis of elongation 250 of the RF applicator 124.

According to embodiments of the present invention, RF heating systems as described herein may utilize at least one datalogger to sense, measure, store, and/or transmit data, such as, for example, temperature data, during at least a portion of the time the articles travel through the RF heating system. For example, a wireless datalogger may be used to measure the temperature of at least one article during at least a portion of the heating in the RF applicator. The resulting temperature data, usually collected as a function of time, can provide valuable information about the thermal history of the article, which may be useful during pasteurization or sterilization of various ingestible substances. For example, the temperature-time data can be used to determine whether the article has been exposed to sufficient energy to achieve a target rate of microbial lethality, thereby ensuring sufficient pasteurization or sterilization of the article.

Figure 7:
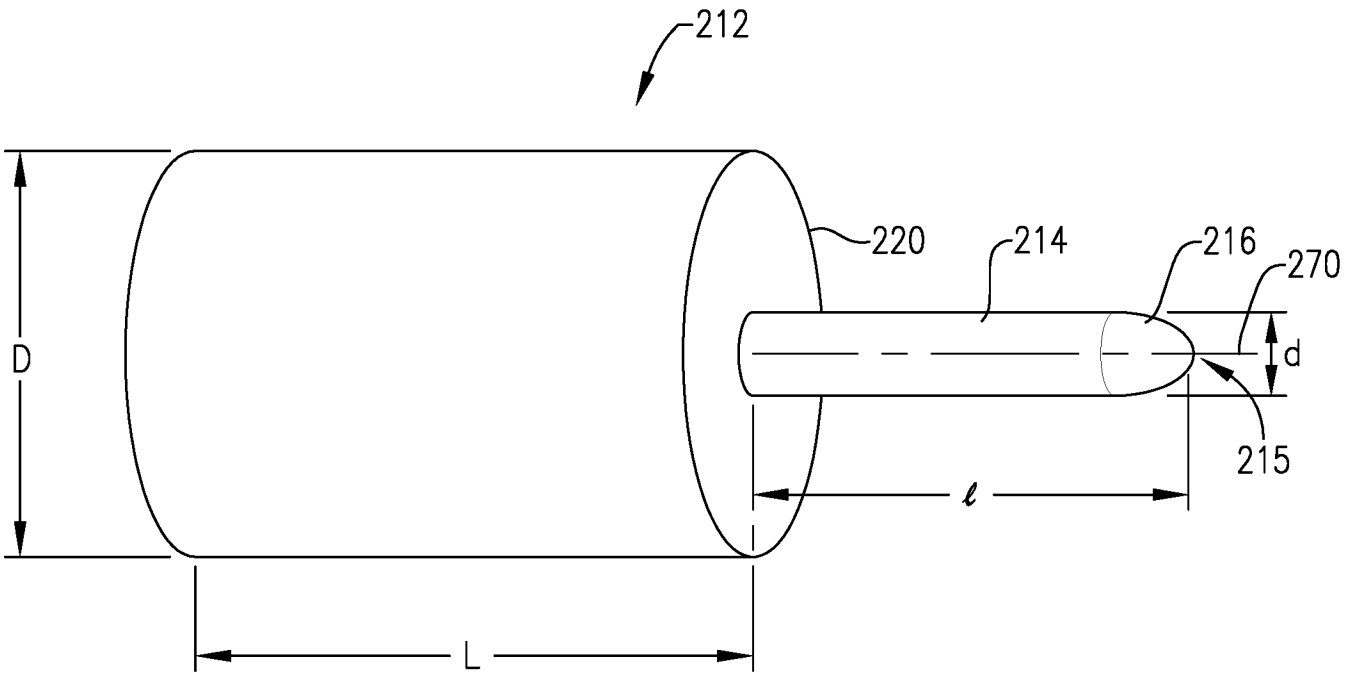
FIG. 7 is a perspective view of a wireless datalogger according to one embodiment of the present invention.
Figure 8A:
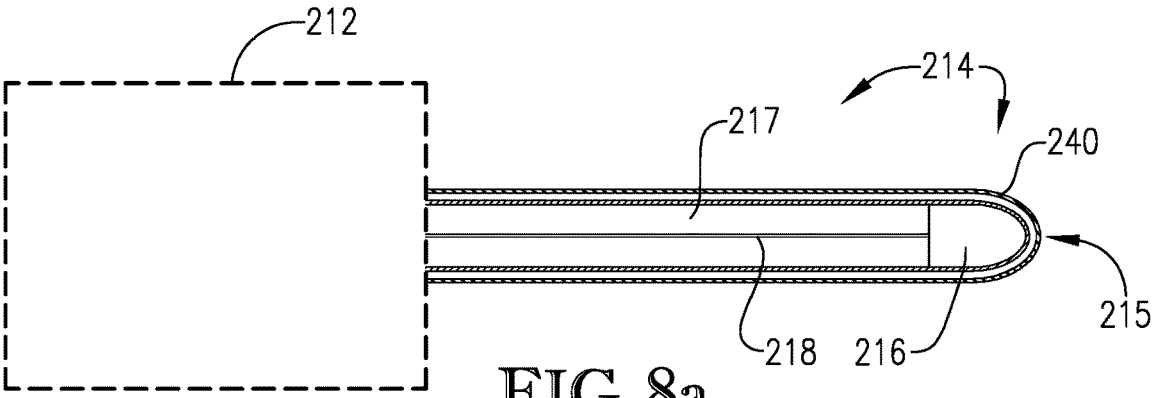
FIG. 8*a* is a partially schematic cross-sectional view of a wireless datalogger configured according to embodiments of the present invention, particularly illustrating a probe including a sheath of electrically conductive material.
Figure 8B:
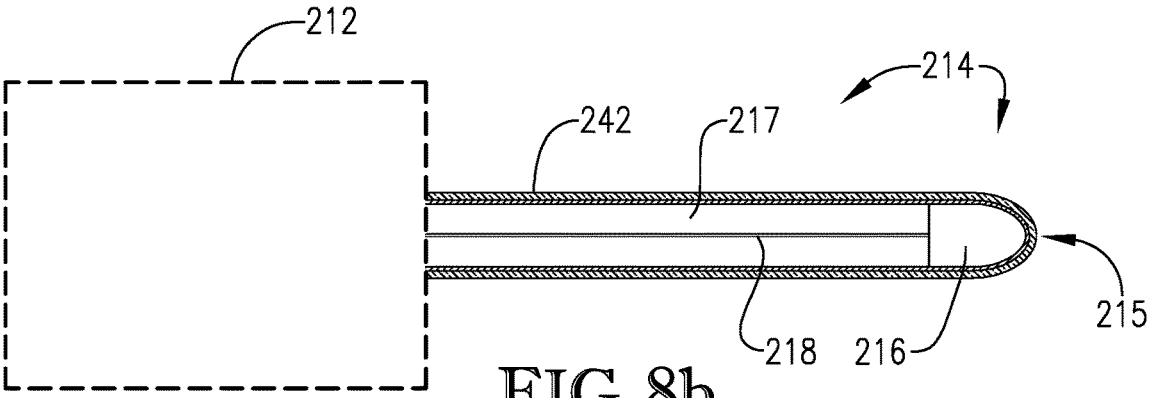
FIG. 8*b* is a partially schematic cross-sectional view of a wireless datalogger configured according to embodiments of the present invention, particularly illustrating a probe including a coating of electrically conductive material.
Figure 8C:
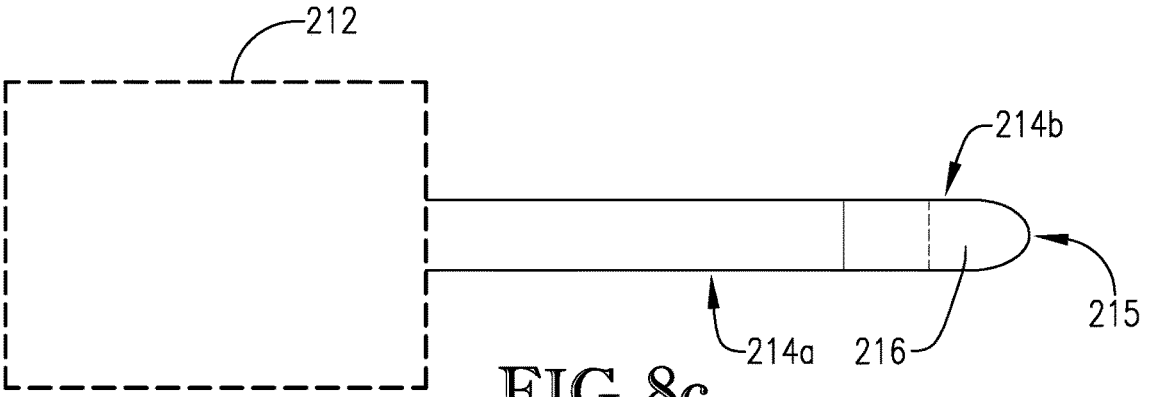
FIG. 8*c* is a partially schematic cross-sectional view of a wireless datalogger configured according to embodiments of the present invention, particularly illustrating a probe at least partially formed from electrically conductive material.
Figure 8D:
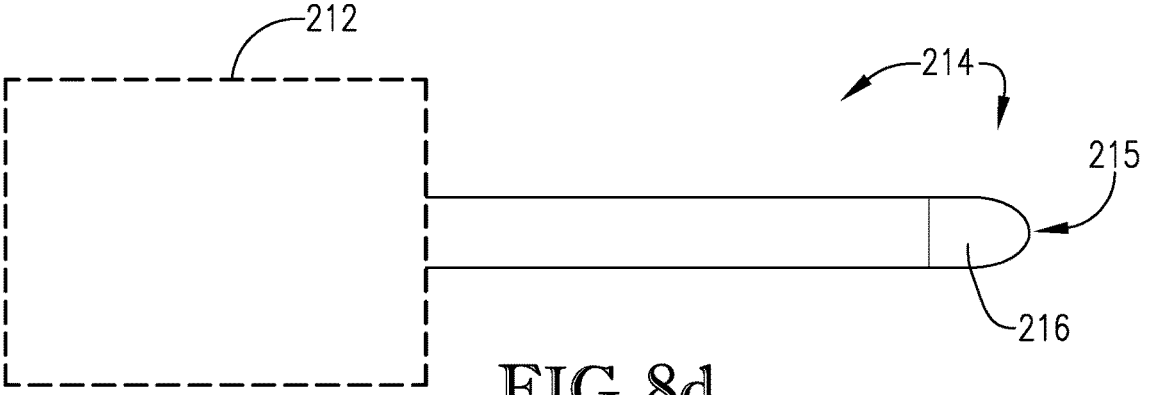
FIG. 8*d* is a partially schematic cross-sectional view of a wireless datalogger configured according to embodiments of the present invention, particularly illustrating a probe substantially formed from electrically conductive material.
Figure 9:
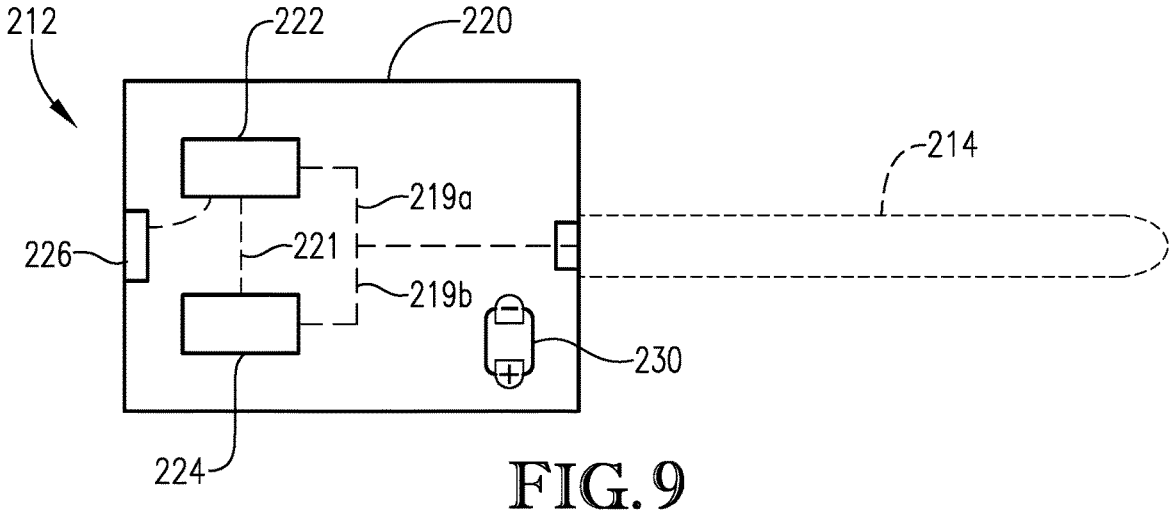
FIG. 9 is a schematic cross-sectional view of a wireless datalogger configured according to embodiments of the present invention, particularly illustrating the components inside the main body of the datalogger.

Several embodiments of wireless dataloggers suitable for use in aspects the present invention are shown in FIGS. 7-9. As shown in the Figures, the datalogger may include a main body 212 and an elongated probe 214. The main body 212 can be formed of any suitable material, including, for example, an electrically conductive material as described below. In some embodiments, at least a portion of the main body 212 may be formed from, or shielded by, at least one polymeric material, such as polyetheretherketone (PEEK). The diameter of the main body 212, shown as D in FIG. 7, can be at least about 10, at least about 12, at least about 15, or at least about 20 mm and/or not more than about 50, not more than about 40, not more than about 35, not more than about 30, or not more than about 25 mm, while the length of the body, L, can be at least about 15, at least about 20, at least about 25, at least about 30, at least about 35, at least about 40, at least about 45, at least about 50, or at least about 55 mm and/or not more than about 120, not more than about 110, not more than about 100, not more than about 95, not more than about 90, not more than about 85, not more than about 80, not more than about 75, not more than about 70, not more than about 65, not more than about 60, or not more than about 55 mm.

As shown in FIG. 7, the probe 214 can be coupled to and extend outwardly from one end of the main body 212 along a direction of extension 270. The distal end 215 of the probe can have any suitable shape, including, for example, rounded as shown in FIGS. 7 and 8*a*-8*d*, or it can be pointed, flat, or angled. The probe 214 may be hollow (as shown in FIGS. 8*a* and 8*b*), or it may be solid (as shown in FIGS. 8*c* and 8*d*). The dimensions of the probe 214 can be sufficient to permit contact with the desired portion of the ingestible item. In some embodiments, the length of the probe 214, shown as l in FIG. 7, can be at least about 5, at least about 10, at least about 25, at least about 30, at least about 40, at least about 50, at least about 60, at least about 75, at least about 90, or at least about 100 mm and/or not more than about 500, not more than about 300, not more than about 200, not more than about 100, or not more than about 75 mm. The diameter (d) of the probe 214 can be at least about 1, at least about 2, or at least about 3 mm and/or not more than about 10, not more than about 8, or not more than about 5 mm. As shown in FIG. 7, the distal end 215 of the probe 214 may be closed to the external environment.

The datalogger may also include at least one temperature sensor 216 positioned near the distal end 215 of the elongated probe 214. In some embodiments, at least a portion of the probe 214 defines an internal cavity 217 and the temperature sensor 216 may be positioned at least partially inside the internal cavity, as generally shown in FIGS. 8*a* and 8*b*. The datalogger may also include at least one wire 218 extending from the temperature sensor 216 to the main body 212 of the datalogger, and, when present, the wire 218 may extend through at least a portion of the internal cavity 217 of the probe 214 as also shown in FIGS. 8*a* and 8*b*. In other embodiments, the probe 214 may be solid and the temperature sensor 216 may be coupled to the distal end 215 of the probe 214, as generally shown, for example, in FIGS. 8*c* and 8*d*.

Any suitable type of temperature sensor may be used, including, but not limited to, a thermistor, a resistance temperature device (RTD), a thermocouple, a platinum resistance bulb, a bulk silicon device, and a solid-state device. The temperature sensor 216 moves through the RF heating system with the articles and is used to measure the temperature of the article, not the interior of the vessel or RF applicator. The temperature sensor 216 is fully contained within the interior volume of the vessel or vessels through which the articles pass or are held during the heating process.

The datalogger may also comprise at least one electrically conductive material at least partially, substantially, or totally surrounding the temperature sensor 216. The electrically conductive material can have an electrical conductivity greater than about $2\times10^6$, greater than about $2.5\times10^6$, greater than about $3\times10^6$, greater than about $3.5\times10^6$, greater than about $4\times10^6$, greater than about $4.5\times10^6$, greater than about $5\times10^6$, greater than about $7.5\times10^6$, greater than about $9\times10^6$, or greater than about $1\times10^7$ Siemens per meter (S/m), measured at 20° C. Additionally, the electrically conductive material can have an electrical conductivity of not more than about $5\times10^8$, not more than about $1\times10^8$, or not more than about $7.5\times10^7$ S/m, measured at 20° C. In some embodiments, the electrically conductive material may be a metal and can comprise gold, copper, silver, brass, and combinations thereof. The electrically conductive material may not be stainless steel and can include, for example, not more than about 1, not more than about 0.5, not more than about 0.25, or not more than about 0.1 weight percent of stainless steel.

In some embodiments, the probe 214 of the datalogger may be formed of a probe material which can have an electrical conductivity less than the conductivity of the electrically conductive material. For example, in some embodiments, the probe material can have an electrical conductivity, measured at 20° C., that is at least about 2, at least about 5, at least about 10, at least about 15, at least about 25, at least about 35, at least about 50 and/or not more than about 75, not more than about 70, not more than about 60, or not more than about 50 percent lower than the electrical conductivity of the electrically conductive material, based on the conductivity of the electrically conductive material. The probe material can have an electrical conductivity of not more than about $1.75\times10^6$, not more than about $1.65\times10^6$, or not more than about $1.5\times10^6$ S/m, at 20° C. In some embodiments, the probe material can have an electrical conductivity greater than $2.5\times10^6$ S/m at 20° C., but still lower than the conductivity of the electrically conductive material by an amount in the ranges provided previously.

In some embodiments, the electrically conductive material can cover at least a portion of the probe material. For example, in some embodiments, the electrically conductive material can be in the form of a sheath that extends over at least a portion of the probe material, one example of which is shown as sheath 240 in FIG. 8*a*. In other embodiments, the electrically conductive material can cover at least a portion of the probe material as a coating applied to all or part of the probe material. One example of such a coating 242 is shown in FIG. 8*b*. In some embodiments, the electrically conductive material can cover substantially all of the probe material. As used herein, the term "substantially all," as it relates to surface area of the probe means more than 50 percent. In some embodiments, the electrically conductive material can cover at least about 55, at least about 60, at least about 65, at least about 70, at least about 75, at least about 80, at least about 85, at least about 90, or at least about 95 percent, or all of surface area of the probe material.

In some embodiments, particularly shown in FIGS. 8*c* and 8*d*, at least a portion of the probe 214 can be formed from the electrically conductive material. As shown in FIG. 8*c*, a first length of the probe, shown as 214*a*, can be formed from the probe material, while a second length, shown as 214*b*, can be formed from the electrically conductive material, with the electrically conductive material surrounding the temperature sensor 216. In some embodiments, at least about 50, at least about 55, at least about 60, at least about 65, at least about 70, at least about 75, at least about 80, at least about 85, at least about 90, at least about 95 percent of the probe 214 can be formed from the electrically conductive material, or the probe 214 can be entirely formed from the electrically conductive material.

Turning now to FIG. 9, the main body 212 of the datalogger can include a housing 220 one or more components for controlling the acquisition, storage, and/or transmission of data collected by the temperature sensor 216. The housing 220 can be formed of any suitable material and may optionally be coated with or sheathed in a plastic or other material of low electrical conductivity. The material used to form the housing 220 may not interfere with the RF energy field within the system, while also being capable of withstanding the conditions to which it may be exposed within the vessel and article (e.g., acidic environments, high pressures, etc.). In some embodiments, the housing 220 may not contact the ingestible substance when the datalogger is collecting data, while, in other embodiments, housing 220 may at least partially, or fully, contact the ingestible substance within the package. Additionally, the datalogger can include a battery 230 for powering the datalogger.

The datalogger also comprises a memory 222 configured to store the data collected by the temperature sensor 216. In some embodiments, the memory 222 may store temperature data as a function of time. As shown in FIG. 9, the datalogger may be configured to transmit the collected data via a signal 219*a* from temperature sensor 216 to memory 222. In some cases, the data may simply be stored in memory 222 for retrieval after the article has been removed from the RF heating system. In such cases, data from the memory 222 of the datalogger may be removed via an electronic communication port 226, which can be configured to provide electronic communication between the datalogger and a separate computing device (not shown). In some embodiments, the electronic communication port 226 may be a port suitable for receiving an input plug, such as, for example a USB or microUSB plug so that the stored data may be transmitted from the memory 222 of the datalogger to the computing device via a wire. In other embodiments, the electronic communication port 226 may be a wireless transmitter capable of transmitting data from the memory 222 of the datalogger to an external computing device without wires. In some cases, when the electronic communication port 226 is a wireless transmitter, all or a portion of the data collected in the memory 222 may be transmitted to the external computing device in or nearly in real-time, while the articles are passing through the RF heating system. In other embodiments, whether wireless or not, all or a portion of the data collected in memory 222 may be transmitted to the external computer after the articles have been withdrawn from the RF heating system.

In some embodiments, the datalogger may also include at least one programmable microprocessor 224 for controlling the acquisition and storage of the data collected by the temperature sensor 216. For example, in some embodiments, the microprocessor 224 may be configured to start or stop temperature collection during a portion of the heating process. It may change the rate of data collection by increasing or decreasing the number of measurements taken in a given time period, or it may stop temperature measurements altogether. Such programmed starts, stops, and any changes to the collection rate can be initiated by achievement of a predetermined time and/or temperature. In some embodiments, the microprocessor 224 may be programmed to alternately collect and not collect temperature data during all or a part of the RF heating process.

In some cases, the microprocessor 224 may be programmed to permit collection of temperature data only in certain vessels or zones (e.g., in the RF applicator during heating with RF energy), while in other embodiments, the microprocessor 224 may permit data collection during the initial thermal regulation zone, the RF heating zone, and the subsequent thermal regulation zone. In some embodiments wherein the datalogger is configured to transmit data wirelessly during the heating process, microprocessor 224 may be configured to provide alerts when the collected data exceeds certain predetermined maximum threshold values or falls below certain minimum threshold values.

In some embodiments, the datalogger may be placed at least partly, or fully, inside at least one of the articles and may be in contact with a portion of the ingestible substance. The datalogger may be oriented such that the probe and/or temperature sensor contact a known or suspected cold spot, a known or expected hot spot, the geometric center of the article, or other location. When a plurality of articles are being heated in the RF heating system, the temperature of two or more different articles may be measured using two or more different dataloggers. The articles may be adjacent to one another or may be spaced apart from one another. The dataloggers may be positioned in similar locations within the articles (e.g., both in a suspected cold spot or both at the geometric center) or in different locations in each article (e.g., one in the geometric center and one in a known hot spot). In some embodiments, two or more dataloggers can be used to measure the temperature of different locations within a single article.

Figure 10A:
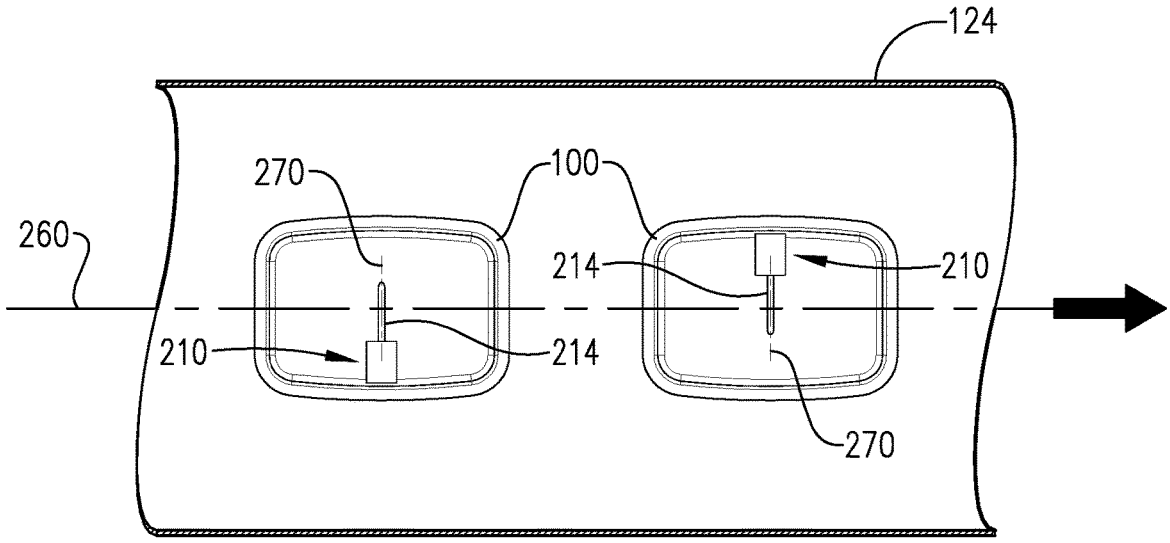
FIG. 10*a* is a top cross-sectional view of a portion of the RF heating system, particularly illustrating the orientation of the wireless dataloggers in the articles relative to the orientation of the axis of convey through the system.

When used in an RF heating system as described herein, the datalogger can be oriented such that the direction of extension 270 of the probe 214 extends in a direction substantially perpendicular to the convey direction, shown as line 260 in FIG. 10*a*, along which the articles 100 are transported through the RF applicator 124. As used herein, the term "substantially perpendicular" means within about 30° of being perpendicular. In some embodiments, the probe 214 of datalogger can be oriented within about 25°, within about 20°, within about 15°, within about 10°, within about 5°, within about 2°, or within about 1° of being perpendicular to the convey direction (or convey axis) 260, or it can be perpendicular to the convey axis, as shown in FIG. 10*a*.

Figure 10B:
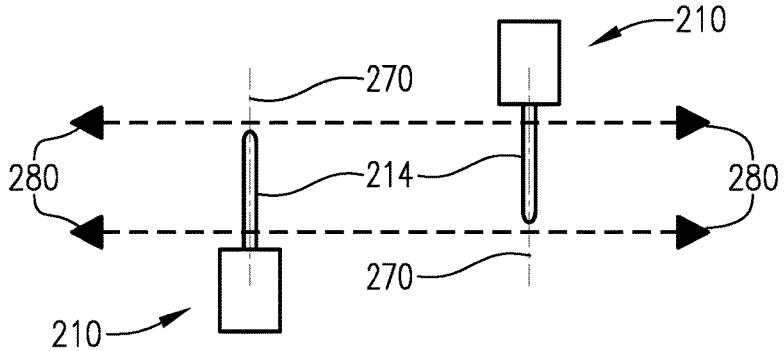
FIG. 10*b* is a schematic depiction of the relative orientation of wireless dataloggers relative to the orientation of the RF energy field according to embodiments of the present invention.

In some embodiments, the probe 214 of the wireless datalogger may be oriented in a direction generally perpendicular to the orientation of the RF energy field 280 within the RF applicator 124, as generally shown in FIG. 10*b*. In some embodiments, the RF energy field created within the interior of the RF applicator 124 may be oriented in a direction generally parallel to the direction of extension of the RF applicator 124 or parallel to the direction of convey along which the convey system 130 transports the article through the RF applicator 124. It has been discovered that orienting the elongated probe substantially perpendicularly to the orientation of the RF energy field helps minimize interactions between the probe and the field, which reduces the amount of current induced by the probe and minimizes the effect of the probe on the temperature profile of the article. In so doing, a more accurate depiction of the temperature of the article over time can be measured with little or no influence from the datalogger.

Returning again to FIG. 1, the articles exiting the RF heating section 18 may be introduced into a subsequent thermal regulation section 20, wherein, ultimately, the average temperature at the geometric center of the articles can be reduced by at least about 5, at least about 10, at least about 15, at least about 20, at least about 25, at least about 30, at least about 35, at least about 40, at least about 45, or at least about 50° C. Thus, the average temperature at the geometric center of the articles withdrawn from the last stage of the subsequent thermal regulation section 20 can be at least about 5, at least about 10, at least about 15, at least about 20, at least about 25, at least about 30, at least about 35, at least about 40, at least about 45, or at least about 50° C. cooler than the average temperature at the geometric center of the articles introduced into the first stage of the subsequent thermal regulation section 20.

The average temperature at the geometric center of the articles withdrawn from the last stage of the subsequent thermal regulation section 20 can be not more than about 120, not more than about 110, not more than about 100, not more than about 90, not more than about 80, not more than about 70, not more than about 60, not more than about 50, not more than about 40° C. lower than the average temperature at the geometric center of the articles entering the subsequent thermal regulation section 20. When the articles are being pasteurized, the temperature of the articles passed through the subsequent thermal regulation section 20 can be reduced by about 10° C. to about 60° C., or about 20° C. to about 40° C. When the articles are being sterilized, the average temperature at the geometric center of the articles passed through the subsequent thermal regulation section 20 can be reduced by about 20° C. to about 120° C. or about 40° C. to about 60° C.

In certain embodiments, the articles can have an average residence time in the subsequent thermal regulation section 20 of at least about 5, at least about 10, at least about 15, at least about 20, at least about 25, at least about 30, at least about 35, at least about 40, at least about 45, or at least about 50 minutes and/or not more than about 120, not more than about 110, not more than about 100, not more than about 90, not more than about 80, not more than about 70, not more than about 60, not more than about 50, or not more than about 40 minutes. When the articles are being pasteurized, the average residence time of the articles in the subsequent thermal regulation section 20 can be in the range of from about 5 minutes to about 60 minutes or about 25 minutes to about 40 minutes. When the articles are being sterilized, the average residence time of the articles in subsequent thermal regulation section 20 can be in the range of from about 15 minutes to about 120 minutes, or about 50 minutes to about 80 minutes.

Referring again to FIG. 2, when the articles passing through the RF heating system are being pasteurized, the subsequent thermal regulation section 20 can include a high-pressure cooling zone 32, a pressure lock 26*b*, and a low-pressure cooling zone 34. Articles being pasteurized are not passed through a hold zone (as shown in FIG. 3), but are instead transitioned directly from the RF heating section 18 into the high-pressure cooling zone 32, as shown in FIG. 2. In the case that the RF heating system includes a hold zone (such, as for example, in the case that the same system is used for both pasteurization and sterilization), the articles being pasteurized can have an average residence time in a hold zone of not more than about 10, not more than about 8, not more than about 6, not more than about 4, not more than about 2, or not more than about 1 minute. Additionally, or in the alternative, not more than about 15, not more than about 12, not more than about 10, not more than about 8, not more than about 5, not more than about 2, or not more than about 1 percent of the total travel path of the articles through the RF heating system may be defined in the hold zone when the articles are being pasteurized. In such embodiments, the average temperature at the geometric center of the articles being pasteurized changes by not more than about 15, not more than about 10, not more than about 5, not more than about 2, or not more than about 1° C. as the articles pass through a hold zone. The temperature of at least about 95, at least about 98, or at least about 99 percent of the total volume of the articles being pasteurized withdrawn from the hold zone, if present, can be within a temperature range of about 2.5, about 2, about 1.5, about 1, about 0.75, about 0.50, or about 0.25° C.

Turning now to FIG. 3, when the articles passed through the RF heating system 10 are being sterilized, the subsequent thermal regulation section 20 includes a thermal isolation zone 28, a hold zone 30, a high-pressure cooling zone 32, a pressure lock 26*b*, and a low-pressure cooling zone 34. Articles exiting the RF heating section 18 may be passed through a thermal isolation zone 28 before entering the hold zone 30. In certain embodiments, the temperature of the fluid (e.g., liquid medium if liquid-filled) in the hold zone 30 may be at least about 2, at least about 5, at least about 8, at least about 10, at least about 12, at least about 15, at least about 18, or at least about 20° C. higher than the average temperature of the fluid (e.g., liquid medium if liquid-filled) in the RF heating section 18. The thermal isolation zone 28 may be configured to transition the articles from the RF heating section 18 to the hold zone 30 while maintaining the difference in temperature between the two zones.

In the hold zone 30, the temperature of each article being sterilized is maintained at or above a specified minimum temperature for a certain amount of time. In certain embodiments, the temperature at the geometric center of each article passing through the hold zone 30 can be maintained at a temperature at or above the average temperature at the geometric center of the articles exiting the RF heating section 18. As a result, the articles exiting the hold zone 30 may be sufficiently and uniformly sterilized.

In certain embodiments, articles passing through hold zone 30 may be contacted with liquid during at least a portion of the hold step. The liquid may comprise or be water and can have a temperature within about 25, within about 20, within about 15, or within about 10° C. of the average temperature at the geometric center of the articles introduced into the hold zone 30. The step of contacting may include submerging the articles in liquid and/or contacting at least a portion of the articles with a jet of liquid emitted from one or more spray nozzles within the hold zone 30.

Overall, the average temperature at the geometric center of the articles passing through the hold zone 30 may increase by at least about 2, at least about 4, at least about 5, at least about 8, at least about 10, or at least about 12° C. and/or not more than about 40, not more than about 35, not more than about 30, not more than about 25, or not more than about 20° C., or it may increase by about 4° C. to about 40° C., or about 10° C. to about 20° C. In certain embodiments, the articles withdrawn from the hold zone 30 can be uniformly heated so that, for example, the temperature of at least about 95, at least about 98, or at least about 99 percent of the total volume of the articles can be within a temperature range of about 2.5, about 2, about 1.5, about 1, about 0.75, about 0.50, or about 0.25° C.

In certain embodiments, the average residence time of each article passed through the hold zone 30 (e.g., the hold time) can be at least about 1, at least about 2, at least about 5, at least about 6, or at least about 8 minutes and/or not more than about 40, not more than about 35, not more than about 30, not more than about 25, not more than about 20, not more than about 15, or not more than about 10 minutes, or it can be in the range of from 2 minutes to 40 minutes or 6 minutes to 20 minutes.

As shown in FIGS. 2 and 3, articles being pasteurized removed from the RF heating section 18, and articles being sterilized removed from the hold zone 30 may be introduced into the high-pressure cooling zone 32. In the high-pressure cooling zone 32 the average temperature at the geometric center of the articles can be reduced by at least about 5, at least about 10, at least about 15, or at least about 20° C. and/or not more than about 60, not more than about 55, not more than about 50, not more than about 45, not more than about 40, not more than about 35, or not more than about 30° C. When the articles are being pasteurized, the average temperature at the geometric center of the articles can be reduced by about 5° C. to about 40° C. or about 10° C. to about 30° C. When the articles are being sterilized, the average temperature at the geometric center of the articles can be reduced by about 10° C. to about 60° C., or about 20° C. to about 40° C. as the articles pass through the high-pressure cooling zone 32.

Articles introduced into the high-pressure cooling zone 32 can have an average temperature at the geometric center of at least about 80, at least about 85, at least about 90, at least about 95, at least about 100, at least about 105, at least about 110, at least about 115, or at least about 120° C. and/or not more than about 135, not more than about 130, not more than about 125, not more than about 120, not more than about 115, not more than about 110, or not more than about 105° C. When the articles are being pasteurized and are introduced into the high-pressure cooling zone 32 from the RF heating section 18, the average temperature at the geometric center of the articles can be in the range of from about 80° C. to about 115° C., or about 95° C. to about 105° C. When the articles are being sterilized and are introduced into the high-pressure cooling zone 32 from the hold zone 30, the average temperature at the geometric center of the articles can be in the range of from about 110° C. to about 135° C. or about 120° C. to about 130° C. The average difference between the maximum temperature (i.e., hottest portion) and the minimum temperature (i.e., coldest portion) of each article exiting the hold zone 30 can be not more than about 5, not more than about 2.5, not more than about 2, not more than about 1.5, not more than about 1, or not more than about 0.5° C.

In certain embodiments, the hold zone 30 can have a pressure of at least about 2, at least about 5, at least about 10, or at least about 15 psig and/or not more than about 80, not more than about 75, not more than about 70, not more than about 65, not more than about 60, not more than about 55, not more than about 50, not more than about 45, not more than about 40, not more than about 35, not more than about 30, not more than about 25, not more than about 20 psig.

The average residence time of the articles passing through the high-pressure cooling zone 32 can be at least about 1, at least about 2, at least about 5, or at least about 10 minutes and/or not more than about 60, not more than about 55, not more than about 50, not more than about 45, not more than about 40, not more than about 35, not more than about 30, not more than about 25, not more than about 20, not more than about 15, or not more than about 10 minutes. When the articles passed through the high-pressure cooling zone 32 are being pasteurized, the average residence time of the articles in high-pressure cooling zone 32 can be in the range of from about 1 minute to about 30 minutes, or about 5 minutes to about 10 minutes. When the articles are being sterilized, the average residence time of the articles passing through the high-pressure cooling zone 32 can be in the range of from about 2 to about 60 minutes, or about 10 to about 20 minutes.

When the articles heated in the RF heating system are being sterilized, the residence time of the articles in the hold zone 30 can be less than, similar to, or greater than the residence time of the articles in the high-pressure cooling zone 32. For example, in certain embodiments, the average residence time of the articles passing through the hold zone 30 can be at least about 5, at least about 10, at least about 15, at least about 20, at least about 25, at least about 30, at least about 35, at least about 40, at least about 45, or at least about 50 percent and/or not more than about 400, not more than about 300, not more than about 200, not more than about 150 percent of the average residence time of the articles passing through the high-pressure cooling zone 32.

When the articles are being pasteurized (and are not passed through a hold zone), the residence time of articles passing through the hold zone can be not more than about 25, not more than about 20, not more than about 15, not more than about 10, or not more than about 5 percent of the residence time of the articles passing through the high-pressure cooling zone 32. When the articles are being sterilized, the residence time of the articles passing through the hold zone 30 can be in the range of from about 25 percent to about 400 percent, or about 50 percent to about 150 percent of the average residence time of the articles passing through the high-pressure cooling zone 32.

Articles passing through the high-pressure cooling zone 32 may be contacted with liquid during at least a portion of the cooling step. The liquid may comprise or be water and can have a temperature within about 25, within about 20, within about 15, or within about 10° C. of the average temperature at the geometric center of the articles withdrawn from the outlet of the high-pressure cooling zone 32. The step of contacting may include submerging the articles in liquid and/or contacting at least a portion of the articles with a jet of liquid emitted from one or more spray nozzles within the high-pressure cooling zone 32.

In certain embodiments, when the hold zone 30 and the high-pressure cooling zone 32 are at least partially liquid filled, the average temperature of the liquid in the hold zone 30 can be at least about 20, at least about 25, at least about 30, at least about 35, at least about 40, at least about 45, at least about 50, at least about 55, at least about 60, at least about 65, at least about 70, at least about 75, at least about 80, at least about 85, at least about 90, at least about 95, or at least about 100° C. and/or not more than about 200, not more than about 190, not more than about 180, not more than about 170, not more than about 160, not more than about 150, not more than about 140, not more than about 130, not more than about 120, not more than about 110, not more than about 100, or not more than about 90° C. higher than the average temperature of the liquid in the high-pressure cooling zone 32. Additionally, or in the alternative, the pressures of the hold zone 30 and the high-pressure cooling zone 32 may be within about 10, within about 5, within about 2, or within about 1 psig of one another.

As shown in FIGS. 2 and 3, the articles exiting the high-pressure cooling zone 32 can be passed through another pressure lock **26*b* before entering the low-pressure cooling zone 34. Similarly to pressure lock 26*a* described previously with respect to FIGS. 11 and 12, the pressure lock 26*b* can be configured to transition the articles between two environments having different pressures. Pressure lock 26*b* shown in FIGS. 2 and 3 may be configured to transition the articles from a higher-pressure environment to a lower-pressure environment, such as, for example, from the high-pressure cooling zone 32 to the low-pressure cooling zone 34. In certain embodiments, the high-pressure cooling zone 32 can have a pressure that is at least about 2, at least about 5, at least about 10, or at least about 15 psig and/or not more than about 50, not more than about 40, not more than about 30, not more than about 20, or not more than about 10 psig higher than the pressure in high-pressure cooling zone 32**.

Low-pressure cooling zone 34 may be configured to reduce the temperature at the geometric center of the articles by at least about 5, at least about 10, at least about 15, at least about 20, at least about 25, at least about 30, at least about 35, or at least about 40° C. and/or not more than about 100, not more than about 95, not more than about 90, not more than about 85, not more than about 80, not more than about 75, not more than about 70, not more than about 65, not more than about 60, or not more than about 55° C. When the articles are being pasteurized, the low-pressure cooling zone 34 may reduce the temperature at the geometric center of the articles passing therethrough by about 5° C. to about 100° C. or about 50° C. to about 80° C. When the articles are being sterilized, the low-pressure cooling zone 34 may reduce the temperature at the geometric center of the articles by about 10° C. to about 75° C. or about 40° C. to about 60° C.

When removed from the low-pressure cooling zone 34, the articles may be at a suitable handling temperature. For example, the temperature at the geometric center of the articles exiting the low-pressure cooling zone 34 can be at least about 50, at least about 55, at least about 60, at least about 65, at least about 70, at least about 75, or at least about 80° C. and/or not more than about 100, not more than about 97, not more than about 95, not more than about 90, or not more than about 85° C. When being pasteurized, the articles withdrawn from the low-pressure cooling zone 34 can have an average temperature at the geometric center in the range of from about 50° C. to about 97° C. or about 80° C. to about 95° C. When being sterilized, the average temperature at the geometric center of the articles exiting the low-pressure cooling zone 34 can be about 50° C. to about 100° C. or about 80° C. to about 97° C. The average difference between the maximum temperature (i.e., hottest portion) and the minimum temperature (i.e., coldest portion) of each article exiting the low-pressure cooling zone can be not more than about 5, not more than about 2.5, not more than about 2, not more than about 1.5, not more than about 1, or not more than about 0.5° C.

The average residence time of the articles passing through the low-pressure cooling zone 34 can be at least about 1, at least about 2, at least about 5, at least about 8, at least about 10, at least about 12, or at least about 15 minutes and/or not more than about 80, not more than about 70, not more than about 60, not more than about 50, not more than about 40, not more than about 30, or not more than about 20 minutes. When the articles are being pasteurized, the average residence time of the articles in the low-pressure cooling zone 34 can be in the range of from about 1 minute to about 80 minutes, or about 5 minutes to about 20 minutes. When the articles are being sterilized, the average residence time of the articles in the low-pressure cooling zone 34 can be in the range of from about 2 minutes to about 80 minutes or about 15 minutes to about 40 minutes.

As shown in FIG. 1, the cooled articles exiting the low-pressure cooling zone 34 may be removed from the RF heating system 10 via an unloading zone 22. Any suitable method or device may be used to remove the articles from contact with liquid in unloading zone 22. The temperature at the geometric center of the articles removed from the unloading zone 22 can be at least about 25, at least about 30, at least about 35, at least about 40, at least about 45, or at least about 50° C. and/or not more than about 80, not more than about 75, not more than about 70, not more than about 65, or not more than about 60° C. The unloading zone may be operated at approximately ambient temperature and/or pressure. Once removed from the unloading zone 22, the articles may be transported for further processing, storage, shipment, or use.

The RF heating systems as described herein may be configured to achieve an overall production rate of at least about 2, at least about 5, at least about 10, at least about 15, at least about 20, at least about 25, at least about 30, at least about 35, at least about 40, at least about 45, at least about 50 articles per minute (articles/min) and/or not more than about 500, not more than about 450, not more than about 400, not more than about 350, not more than about 300, not more than about 250, not more than about 200 articles/min. In other embodiments, the mass convey rate of the food (or other ingestible substance) passing through the RF heating system can be at least about 1, at least about 5, at least about 10, at least about 15, at least about 20, or at least about 25 pounds of food (or other ingestible substance) per minute (lb/min) and/or not more than about 500, not more than about 450, not more than about 400, not more than about 350, not more than about 300, not more than about 250, not more than about 200, not more than about 150 lb/min.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventor hereby states his intention to rely on the Doctrine of Equivalents to determine and assess the reasonably fair scope of the present invention as pertains to any method or apparatus departing from but not outside the literal scope of the invention as set forth in the following claims.

We claim:

1. A process for heating a plurality of articles using radio frequency (RF) energy, said process comprising:

(a) conveying a plurality of articles through an RF heating chamber;

(b) during at least a portion of said conveying, heating said plurality of articles in said RF heating chamber using RF energy;

(c) during at least a portion of said heating, measuring temperature data of at least one of said articles over a period of time to provide measured temperature-time data, wherein said measuring is carried out using a wireless datalogger having an elongated probe extending at least partly into said article, wherein said probe comprises a first portion formed from a first electrically conductive material having an electrical conductivity greater than $2\times10^6$ S/m at 20° C. and a second portion formed from a second less electrically conductive material having an electrical conductivity of not more than $1.75\times10^6$ S/m at 20° C., wherein at least part of the first portion of said probe extends into said article, wherein said elongated probe is oriented substantially perpendicular to the direction of orientation of the RF energy field used to heat said plurality of articles in said RF heating chamber during said heating of step (b);

(d) storing at least a portion of said measured temperature-time data in a memory of said datalogger to provide stored temperature-time data; and (e) removing at least a portion of said stored temperature-time data from said memory of said datalogger via at least one electronic communication port of said datalogger, wherein said removing of step (e) is carried out after said articles have been withdrawn from said RF heating system.

2. The process of claim 1, wherein said datalogger comprises a main body and a temperature sensor, wherein said probe extends from said main body, wherein said temperature sensor is located near a distal end of said probe, and wherein said first electrically conductive material substantially surrounds said temperature sensor.

3. The process of claim 2, wherein said first electrically conductive material is selected from the group consisting of brass, gold, copper, silver, and combinations thereof.

4. The process of claim 1, wherein said conveying of step (a) moves said plurality of articles in a convey direction, wherein said elongated probe is oriented substantially perpendicular to said convey direction.

5. The process of claim 1, wherein during said heating of step (b), said plurality of articles are substantially submerged in a liquid having a conductivity of less than 2 mS/m at 20° C.

6. The process of claim 1, further comprising (i) prior to said conveying of step (a), preheating said articles in a thermal regulation zone upstream of said RF heating chamber and during at least a portion of said preheating, measuring a temperature of at least one of said articles using said datalogger and (ii) subsequent to said heating of step (b), cooling said articles in a cool down zone, and during at least a portion of said cooling, measuring a temperature of at least one of said articles using said datalogger.

7. The process of claim 1, wherein each of said articles comprises a packaged ingestible substance, wherein said elongated probe is in contact with a portion of said ingestible substance during said heating, and wherein said process is a pasteurization or sterilization process.

8. A radio frequency (RF) heating system for heating a plurality of articles using RF energy, said system comprising:

an RF generator for generating RF energy;

an RF waveguide for transmitting RF energy produced by said RF generator;

an RF heating chamber for receiving RF energy transmitted by said RF waveguide;

a convey system for transporting a plurality of articles through said RF heating chamber in a convey direction; and at least one wireless datalogger for measuring temperature data in at least one article over a period of time to provide measured temperature-time data, wherein said wireless datalogger has an elongated probe extending at least partly into said article, wherein said probe comprises a first portion formed from a first electrically conductive material having an electrical conductivity greater than $2\times10^6$ S/m at 20° C. and a second portion formed from a second less electrically conductive material having an electrical conductivity of not more than $1.75\times10^6$ S/m at 20° C., wherein at least part of the first portion of said probe extends into said article, and wherein said probe is oriented substantially perpendicular to said convey direction;

wherein said datalogger further comprises a memory configured to store at least a portion of said measured temperature-time data to provide stored temperature-time data; and at least one electronic communication port configured to transmit at least a portion of said stored temperature-time data between said memory of said datalogger and an external computing device after said datalogger has been withdrawn from said RF heating system.

9. The system of claim 8, wherein said datalogger comprises a main body and a temperature sensor, wherein said elongated probe extends from said main body, wherein said temperature sensor is coupled to said probe near a distal end of said probe, and wherein said first electrically conductive material substantially surrounds said temperature sensor.

10. The system of claim 9, wherein said first electrically conductive material is selected from the group consisting of brass, gold, copper, silver, and combinations thereof.

11. A wireless datalogger for sensing and storing temperature data from articles heated in an RF heating system, said datalogger comprising:

a main body;

an elongated probe extending from said main body;

a single temperature sensor located near a distal end of said probe;

wherein said probe comprises a first portion formed from a first electrically conductive material having an electrical conductivity greater than $2\times10^6$ S/m at 20° C. and a second portion formed from a second less electrically conductive material having an electrical conductivity of not more than $1.75\times10^6$ S/m at 20° C., wherein said first portion of said probe comprises said distal end and said second portion of said probe is located between said distal end and said main body, wherein said electrically conductive material substantially surrounds said temperature sensor;

a memory configured to store temperature-time data collected by said temperature sensor to provide stored temperature-time data; and at least one electronic communication port configured to transmit at least a portion of the stored temperature-time data between said memory of said datalogger and an external computing device after said datalogger has been withdrawn from said RF heating system.

12. The wireless datalogger of claim 11, wherein said first electrically conductive material covers at least a portion of said second less electrically conductive material.

13. The wireless datalogger of claim 12, wherein said first electrically conductive material is in the form of a coating on said second less electrically conductive material and/or in the form of a sheath that extends over at least a portion of said second less electrically conductive material.

14. The wireless datalogger of claim 12, wherein said first electrically conductive material covers substantially all of said second less electrically conductive material.

15. The wireless datalogger of claim 11, wherein said datalogger comprises a programmable microprocessor for controlling the acquisition and storage of said temperature-time data.

* * * * *